US007607944B2

(12) United States Patent
Yoshioka et al.

(10) Patent No.: US 7,607,944 B2
(45) Date of Patent: Oct. 27, 2009

(54) MULTI-POLE COAXIAL CONNECTOR

(75) Inventors: Kosuke Yoshioka, Tsu (JP); Narutoshi Hoshino, Katano (JP); Shuji Kato, Tsu (JP); Hirohisa Tanaka, Tsu (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/046,609

(22) Filed: Mar. 12, 2008

(65) Prior Publication Data

US 2008/0227334 A1 Sep. 18, 2008

(30) Foreign Application Priority Data

| | | |
|---|---|---|
| Mar. 14, 2007 | (JP) | 2007-065689 |
| Mar. 14, 2007 | (JP) | 2007-065692 |
| Mar. 14, 2007 | (JP) | 2007-065743 |
| Mar. 14, 2007 | (JP) | 2007-065754 |
| Mar. 14, 2007 | (JP) | 2007-065755 |

(51) Int. Cl.
*H01R 9/05* (2006.01)

(52) U.S. Cl. ..... 439/579

(58) Field of Classification Search ..... 439/579, 439/585, 581, 63, 607
See application file for complete search history.

(56) References Cited

U.S. PATENT DOCUMENTS

| | | | | |
|---|---|---|---|---|
| 5,975,950 | A * | 11/1999 | Yamaguchi | 439/585 |
| 6,533,609 | B2 * | 3/2003 | Koide | 439/578 |
| 6,540,559 | B1 | 4/2003 | Kemmick et al. | |
| 7,384,306 | B2 * | 6/2008 | Malstrom et al. | 439/578 |
| 2004/0161972 | A1 * | 8/2004 | Laub et al. | 439/585 |
| 2006/0234525 | A1 | 10/2006 | Ookura | |
| 2006/0258227 | A1 | 11/2006 | Ookura | |
| 2007/0049119 | A1 | 3/2007 | Fujimoto et al. | |
| 2007/0105408 | A1 | 5/2007 | Ookura | |
| 2007/0161274 | A1 | 7/2007 | Tanaka et al. | |
| 2008/0026612 | A1 | 1/2008 | Malstrom et al. | |

FOREIGN PATENT DOCUMENTS

| | | |
|---|---|---|
| CN | 101114746 | 1/2008 |
| JP | 58-113979 U | 8/1983 |

(Continued)

OTHER PUBLICATIONS

English language Abstract of JP 2005-108510.

(Continued)

*Primary Examiner*—Phuong K Dinh
(74) *Attorney, Agent, or Firm*—Greenblum & Bernstein, P.L.C.

(57) ABSTRACT

To provide a multi-pole coaxial connector that can be made more compact. More specifically, to provide a multi-pole coaxial connector in which a pitch between members is reduced to reduce a connecting body in size. In a multi-pole coaxial connector in which when a housing block and a receptacle are coupled to each other, a signal post and a signal contact are brought into conduction, a ground contact and a ground case are brought into conduction, an internal conductor and a signal SMD terminal are brought into conduction, and an external conductor and a ground SMD terminal are brought into conduction, and a cross section of the ground contact is formed into substantially U-shape in which adjacent ground contact side is opened.

7 Claims, 19 Drawing Sheets

FOREIGN PATENT DOCUMENTS

| | | | |
|---|---|---|---|
| JP | 2-291679 | A | 12/1990 |
| JP | 3-266383 | A | 11/1991 |
| JP | 6-029047 | U | 4/1994 |
| JP | 6-080283 | U | 11/1994 |
| JP | 7-122335 | | 5/1995 |
| JP | 10-228962 | A | 8/1998 |
| JP | 11-195462 | | 7/1999 |
| JP | 2004-259542 | A | 9/2004 |
| JP | 2004-355932 | | 12/2004 |
| JP | 2005-108510 | | 4/2005 |
| JP | 2006-012647 | A | 1/2006 |

OTHER PUBLICATIONS

English language Abstract of JP 2004-355932.
English language Abstract of JP 7-122335, May 12, 1995.
English language Abstract of JP 11-195462, Jul. 21, 1999.
English language Abstract of JP 10-228962 A (Aug. 25, 1998).
English language Abstract of JP 2006-012647A (Jan. 12, 2006).
English language Abstract of JP 2-291679 A (Dec. 3, 1990).
English language Abstract of JP 3-266383 A (Nov. 27, 1991).
English language Abstract of JP 2004-259542 A (Sep. 16, 2004).
English language Abstract of CN 101114746, Jan. 30, 2008.

* cited by examiner

FIG. 14A
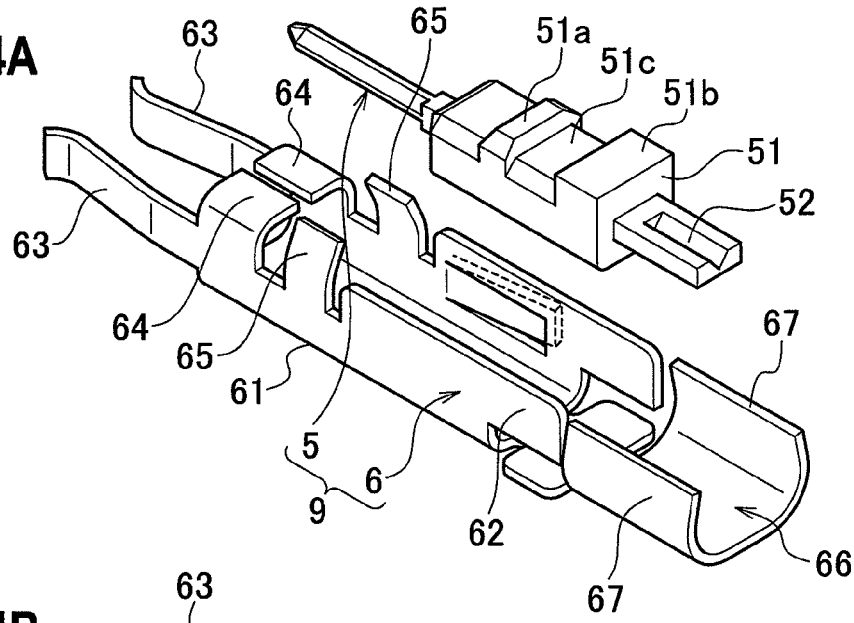
FIG. 14B
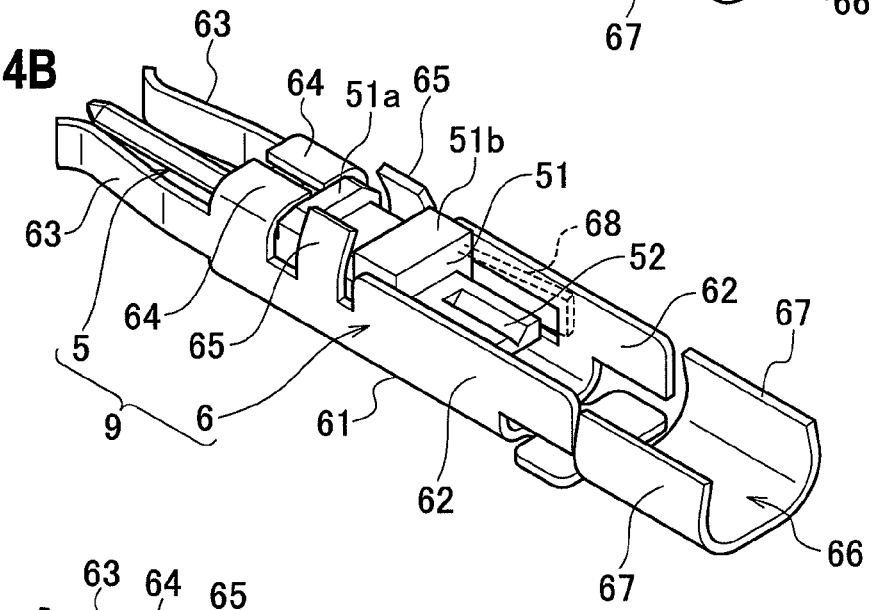
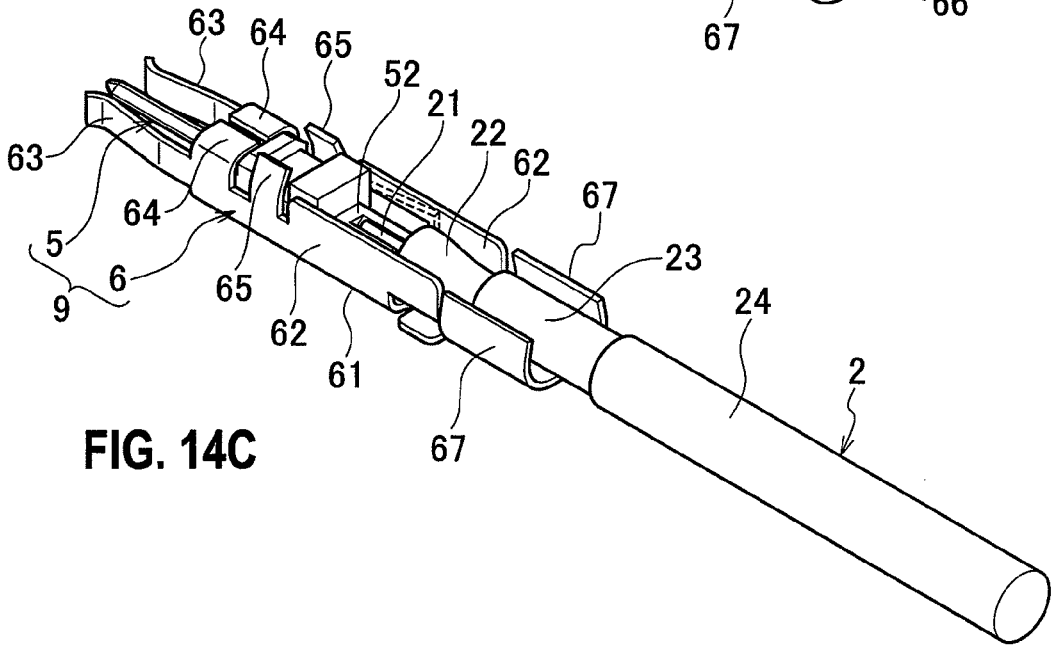
FIG. 14C

MULTI-POLE COAXIAL CONNECTOR

BACKGROUND OF THE INVENTION

1. Field of the Invention

The present invention relates to a multi-pole coaxial connector which connects a coaxial cable connecting body to which a coaxial cable is connected and a stationary side connecting body having a signal terminal and a ground terminal to each other.

2. Description of the Related Art

As a conventional coaxial connector, there is a known coaxial connector that connects coaxial cables to each other as described in Japanese Patent Application Laid-open No. 2005-108510. According to this coaxial connector, a male body as the one connecting body of the coaxial cables and a female body as the other connecting body of the coaxial cables are fitted and coupled to each other, so that an internal conductor and an external conductor of coaxial cables to be connected to each other are brought into conduction through conductive materials provided on the male body and the female body, i.e., a hot terminal or a ground terminal.

According to a conventional multi-pole coaxial connector, the male member and the female member are respectively provided with ground terminals, and these ground terminals are fitted over outer sides of the hot terminals through insulators. At this time, each ground terminal is formed into a cylindrical shape so that the ground terminal can surround the entire circumference of the hot terminal. With this structure, noise resistance can be enhanced, and mutual interference of signal can be suppressed.

Therefore, in the case of a multi-pole coaxial connector in which the male member and the female member are respectively provided with a plurality of coaxial cables, if cylindrical ground terminals are disposed side-by-side, the two thick portions of the adjacent ground terminals exist in the side-by-side direction and thus, a pitch between the ground terminals is increased correspondingly, and the connecting bodies such as the male member and the female member are increased in size in the side-by-side direction of the coaxial cables.

Therefore, it is an object of the present invention to obtain a multi-pole coaxial connector, which can be reduced in size.

SUMMARY OF THE INVENTION

According to the present invention, a multi-pole coaxial connector comprising a coaxial cable connecting body in which a plurality of combinations of a signal post connected to an internal conductor of a coaxial cable and a ground contact which is fitted over the signal post through an insulator and which is connected to an external conductor are disposed in parallel to each other, and a stationary side connecting body in which a plurality of combinations of a signal contact having a signal terminal and a ground case having a ground terminal are disposed in parallel to each other, in which the coaxial cable connecting body and the stationary side connecting body are coupled to each other, thereby bringing the signal post and the signal contact into conduction, and bringing the ground contact and the ground case into conduction, bringing the internal conductor and the signal terminal into conduction and bringing the external conductor and the ground terminal into conduction, wherein a cross section of the ground contact is formed into substantially U-shape in which adjacent ground contact side is opened.

According to the present invention, the multi-pole coaxial connector can be configured such that the ground contact includes a swaging unit which presses and fixes from outside of the external conductor, and a cross section of the swaging unit is formed into substantially U-shape surrounding outside of the external conductor except the adjacent ground contact side.

According to the present invention, the multi-pole coaxial connector can be configured such that a cross section of the ground case is formed into substantially U-shape in which adjacent ground case side is opened.

According to the present invention, the multi-pole coaxial connector can be configured such that the signal contact includes a pair of contact pieces which sandwich the signal post from both sides with a repulsion force, the ground case is fitted over the signal contact through an insulator, the ground case is sandwiched between the pair of contact pieces of the ground contact with a repulsion force, and opening and closing directions of the pair of contact pieces of the ground contact and opening and closing directions of the pair of contact pieces of the signal contact are different from each other.

According to the present invention, the multi-pole coaxial connector can be configured such that a contact portion of the ground case sandwiched between the pair of contact pieces of the ground contact is formed into a flat-plate like shape.

According to the present invention, the multi-pole coaxial connector can be configured such that the opening and closing directions of the pair of contact pieces of the ground contact are front and back directions of the stationary side connecting body, and an clearance hole to evade interference with the contact piece is formed in at least one of the front surface and the back surface of the stationary side connecting body.

According to the present invention, the multi-pole coaxial connector can be configured such that the signal terminal and the ground terminal project from the stationary side connecting body in a state where their surface are opposed to each other at a predetermined distance.

According to the present invention, the multi-pole coaxial connector can be configured such that a tip end of the ground terminal opposed to the signal terminal is bifurcated, and tip ends of the bifurcated portions are disposed astride the signal terminal.

BRIEF DESCRIPTION OF THE DRAWINGS

FIGS. 14A to 14C are perspective views showing an assembling procedure of two coaxial cables and a conductive material included in the housing block as the coaxial cable connecting body of the multi-pole coaxial connector according to the embodiment in the order of 14A to 14C;

FIG. 21A is a sectional view taken along the line XXI-XXI in FIG. 13, and FIG. 21B is a sectional view at the same position taken along the line XXI-XXI in FIG. 13.

DETAILED DESCRIPTION OF THE PREFERRED EMBODIMENTS

Embodiments of the present invention will be explained with reference to the accompanying drawings.

As one embodiment of the present invention, there is exemplified a multi-pole coaxial connector, in which a housing block in which a plurality of coaxial cables are connected to a housing as a common portion and a receptacle fixed to a substrate are fitted to each other. In the following explanations, for convenience sake, a front side in an inserting direction of the coaxial cable into the housing of the housing block is defined as front, and a deep side (leading side) is defined as back.

Figure 1:
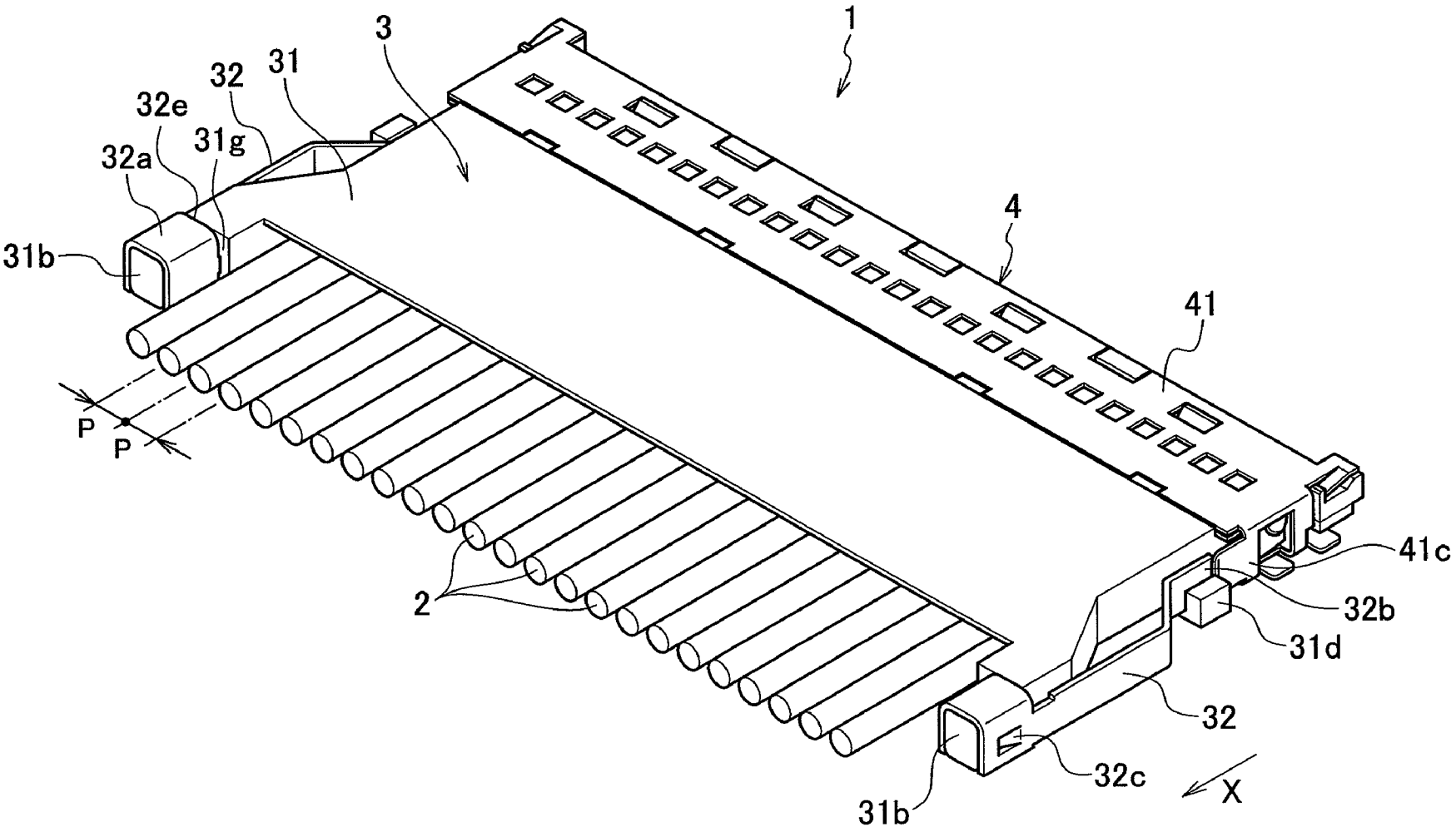
FIG. 1 is a perspective view of an entire multi-pole coaxial connector according to an embodiment of the present invention.
Figure 2:
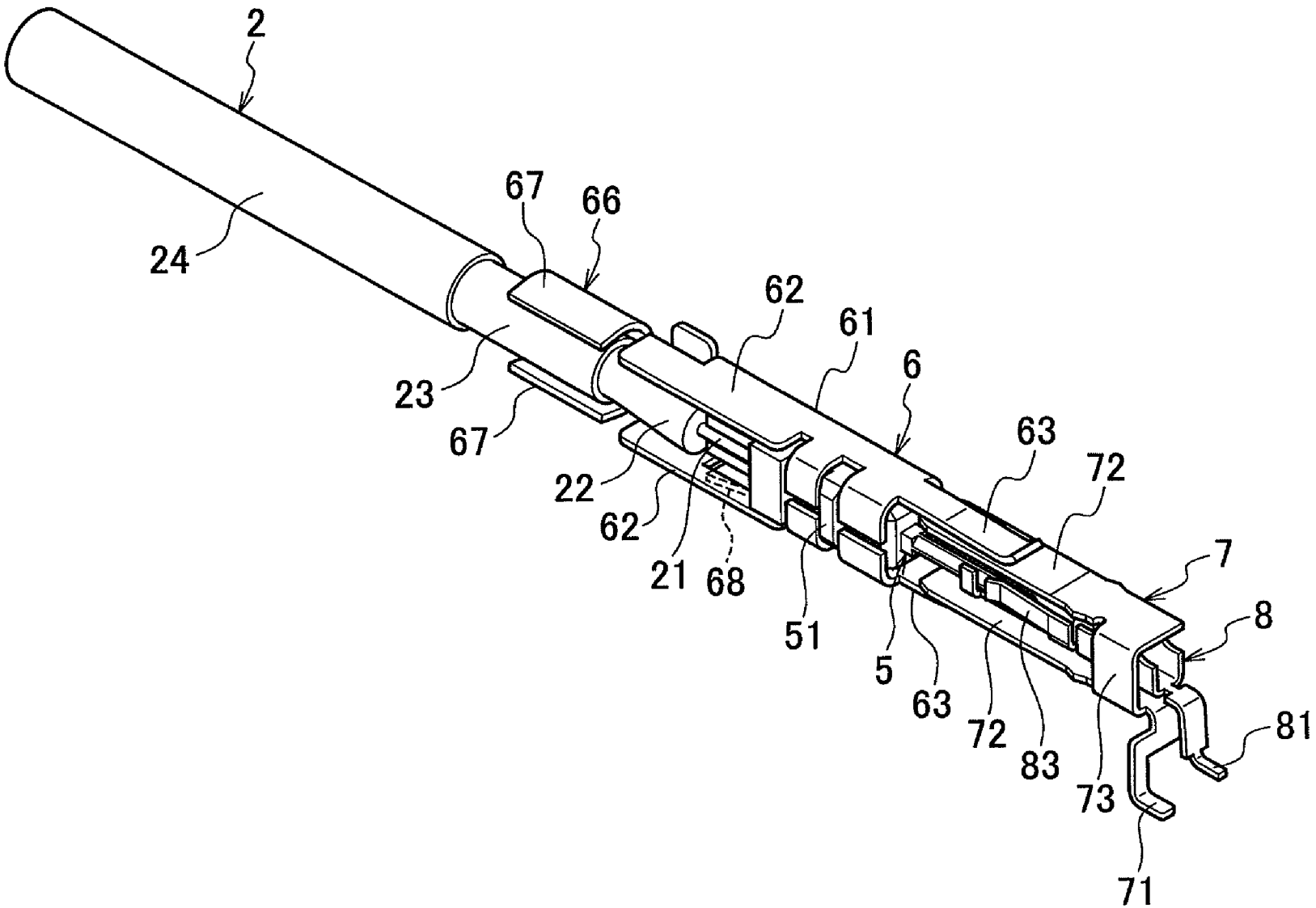
FIG. 2 is a perspective view of a portion of the multi-pole coaxial connector according to the embodiment.

FIG. 1 is a perspective view of an entire multi-pole coaxial connector. FIG. 2 is a perspective view of a portion of the multi-pole coaxial connector.

The multi-pole coaxial connector 1 includes a housing block 3 as a coaxial cable connecting body to which a plurality of coaxial cables 2 are connected, and a receptacle 4 as a stationary side connecting body having a signal SMD terminal (signal terminal) 81 and a ground SMD terminal (ground terminal) 71 as stationary terminals fixed to a substrate (not shown). By fitting and coupling the housing block 3 and the receptacle 4 to each other, the internal conductor 21 of the coaxial cable 2 and the signal SMD terminal 81 are brought into conduction and the external conductor 23 and the ground SMD terminal 71 are brought into conduction through a signal post 5 and a ground contact 6 as conductive materials provided on the housing block 3, and through a ground case 7 and a signal contact 8 as conductive materials provided on the receptacle 4.

The coaxial cable 2 is an electric wire in which characteristics impedance for transmitting unbalanced electric signal is defined. In the present embodiment, as shown in FIG. 2, the coaxial cable 2 includes an internal conductor 21 as a wire material made of conductor, an insulator 22 coating an outer periphery of the internal conductor 21, an external conductor 23 coating an outer periphery of the insulator 22, and a sheath 24 as a protecting coating as an outermost layer. The coaxial cable 2 is formed as a flexible cable having substantially circular cross section.

Figure 3:
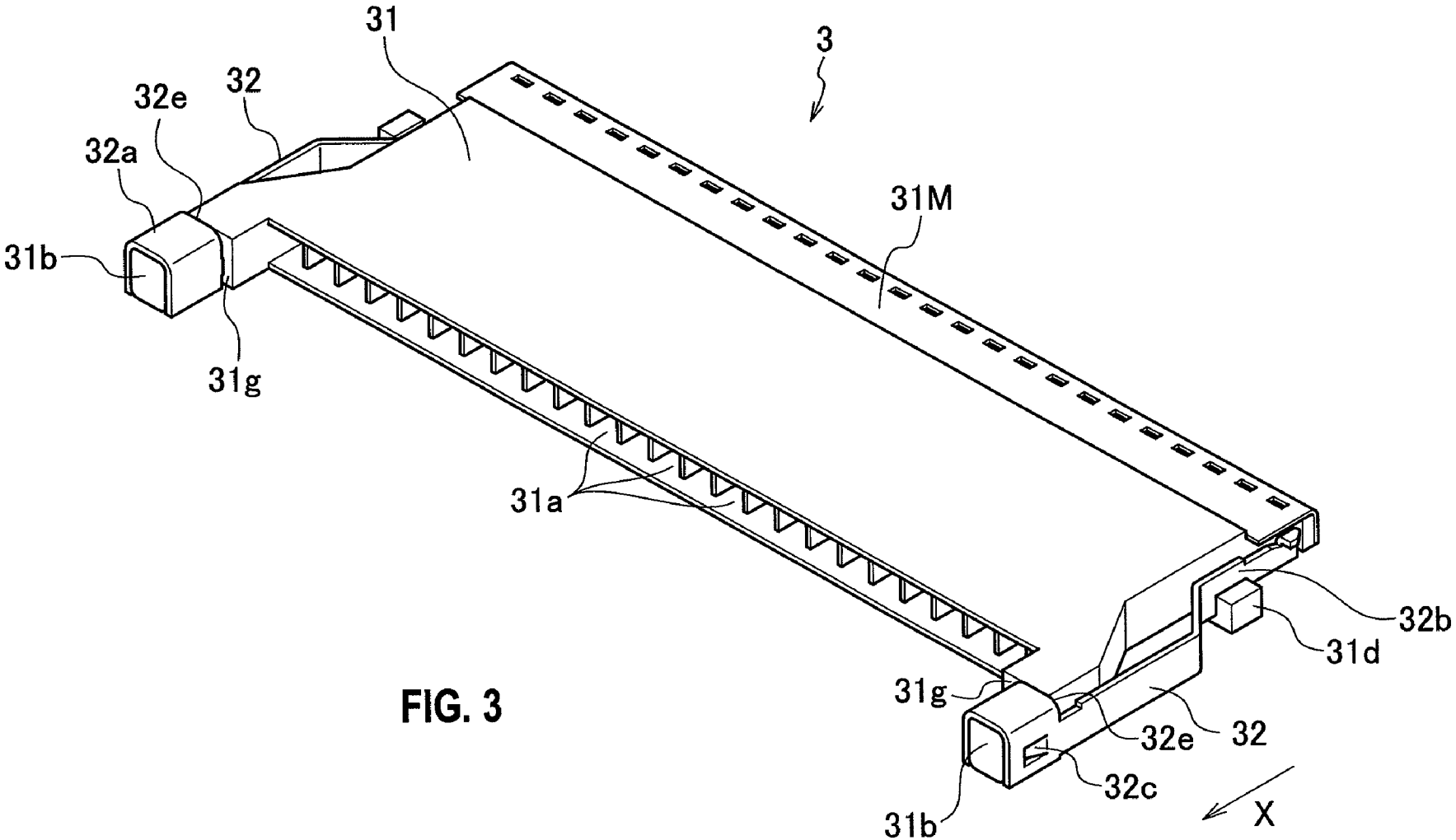
FIG. 3 is a perspective view of a housing included in a housing block as a coaxial cable connecting body of the multi-pole coaxial connector according to the embodiment.
Figure 4:
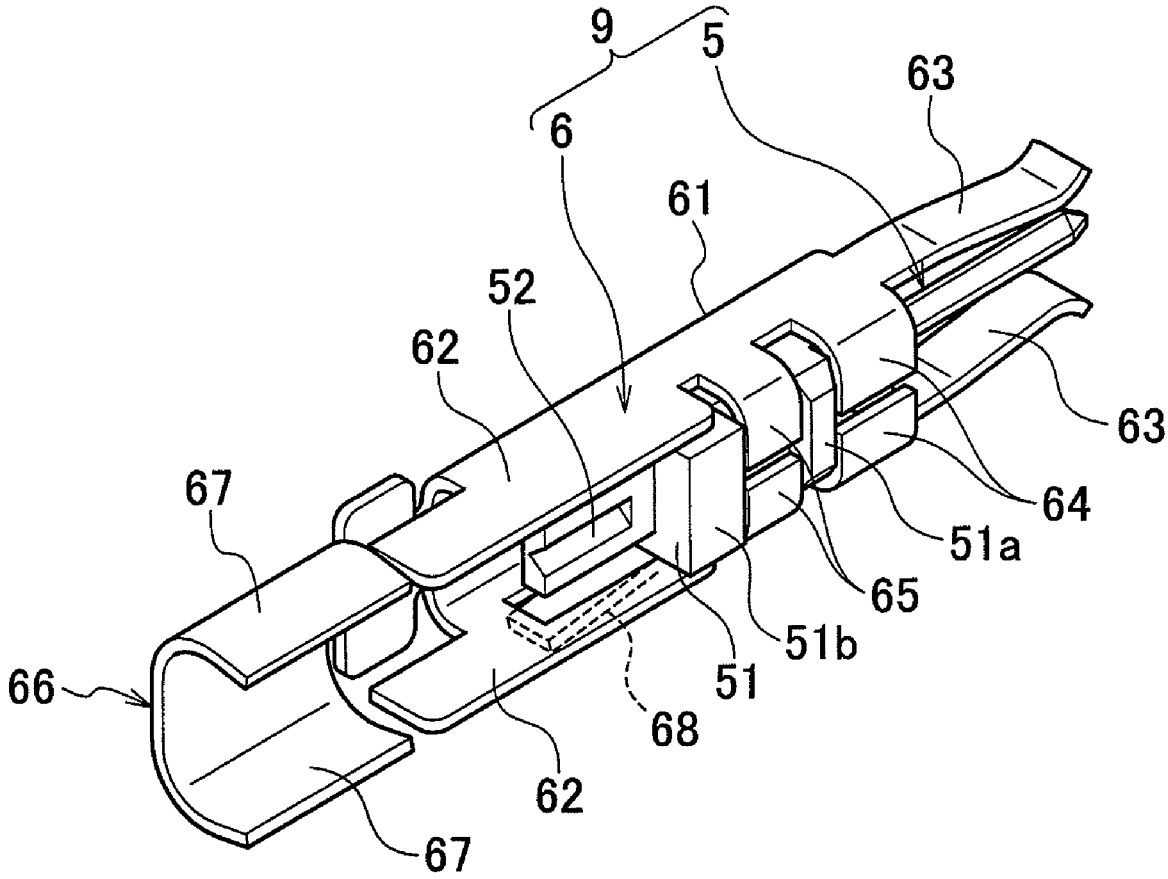
FIG. 4 is a perspective view of an assembly block included in the housing block as the coaxial cable connecting body of the multi-pole coaxial connector according to the embodiment.
Figure 5:
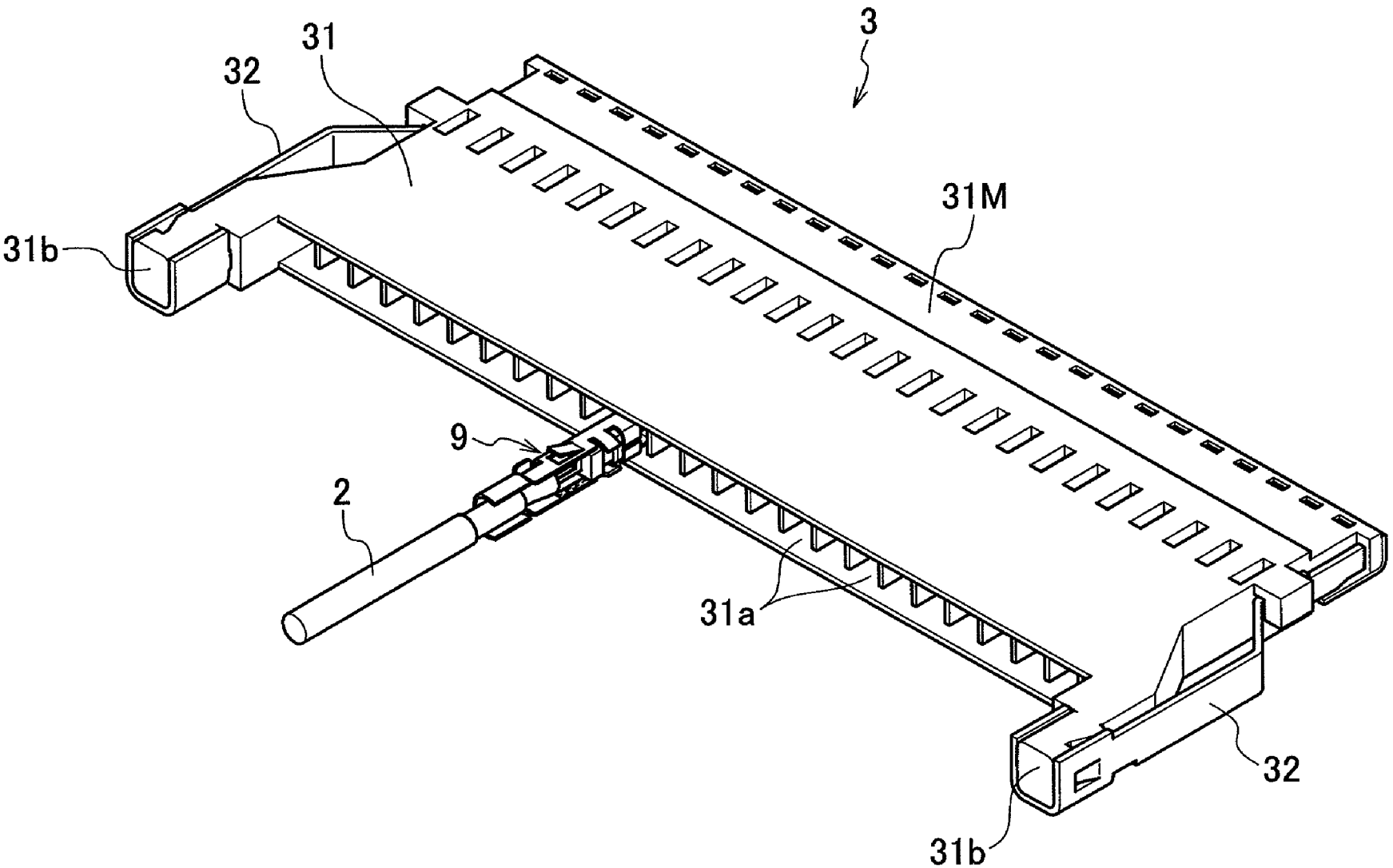
FIG. 5 is a perspective view of an inserted state of the assembly block into the housing included in the housing block as the coaxial cable connecting body of the multi-pole coaxial connector according to the embodiment as viewed from a back surface.

FIG. 3 is a perspective view of the housing included in the housing block. FIG. 4 is a perspective view of an assembly block included in the housing block. FIG. 5 is a perspective view of an inserted state of the assembly block into the housing as viewed from a back surface.

As shown in FIG. 3, the housing block 3 is formed into a substantially rectangular thin plate-like shape. The housing block 3 includes a housing 31 in which a plurality of insertion holes 31*a* having rectangular cross sections are laterally arranged along a longitudinal direction with an terminal pitch P (see FIG. 1), and lock arms 32 provided on both sides of the housing 31 in the longitudinal direction (a left upper direction and a right lower direction in FIG. 3) and engaged with the receptacle 4.

An assembly block 9 in which the signal post 5 and the ground contact 6 are sub-assembled as shown in FIG. 4 is fitted to each insertion hole 31*a* of the housing 31 in a state where the coaxial cable 2 is connected as shown in FIG. 5.

At this time, as shown in FIG. 2, the internal conductor 21 of the coaxial cable 2 is connected to the signal post 5, and the external conductor 23 is connected to the ground contact 6.

The signal SMD terminal 81 is integrally formed on the signal contact 8, and the ground SMD terminal 71 is integrally formed on the ground case 7.

Figure 6:
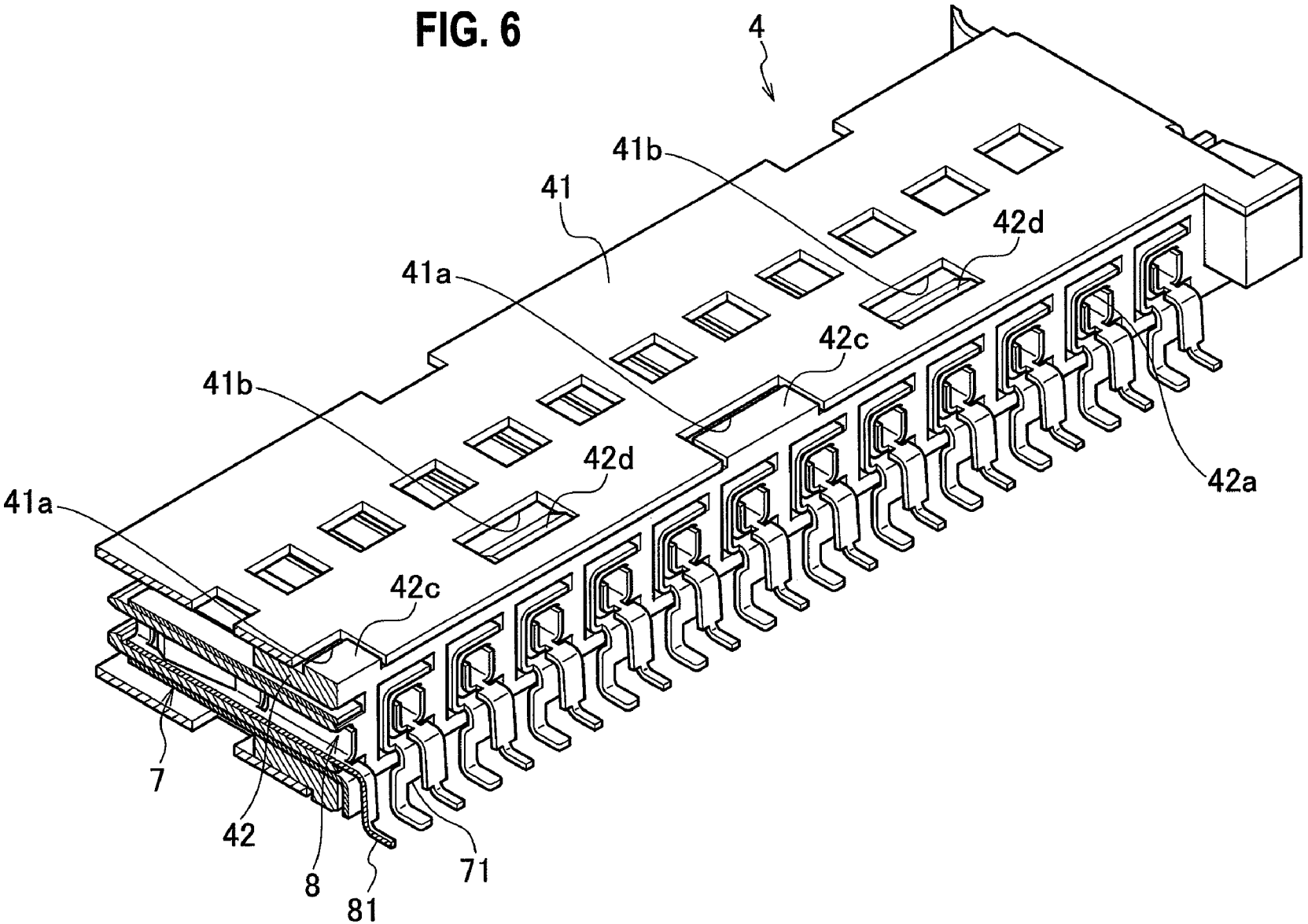
FIG. 6 is an enlarged perspective view of a cross section of a receptacle as a stationary side connecting body of the multi-pole coaxial connector according to the embodiment taken along an intermediate portion thereof.

FIG. 6 is a perspective view of a cross section of the receptacle taken along an intermediate portion thereof. As shown in FIG. 6, the receptacle 4 includes a metal shell 41 forming an outer shell, a synthetic resin insulating body 42 fitted into the shell 41, and the ground cases 7 and the signal contacts 8 fitted (press-fitted) to a plurality of insertion shapes 42*a* formed in the insulating body 42.

A front end of the shell 41 is detachably fitted to an outer side of a fitting unit 31M shown in FIG. 3 so that the housing block 3 and the receptacle 4 are coupled to each other. The fitting unit 31M is formed with a step on the rear portion of the housing 31.

Figure 7:
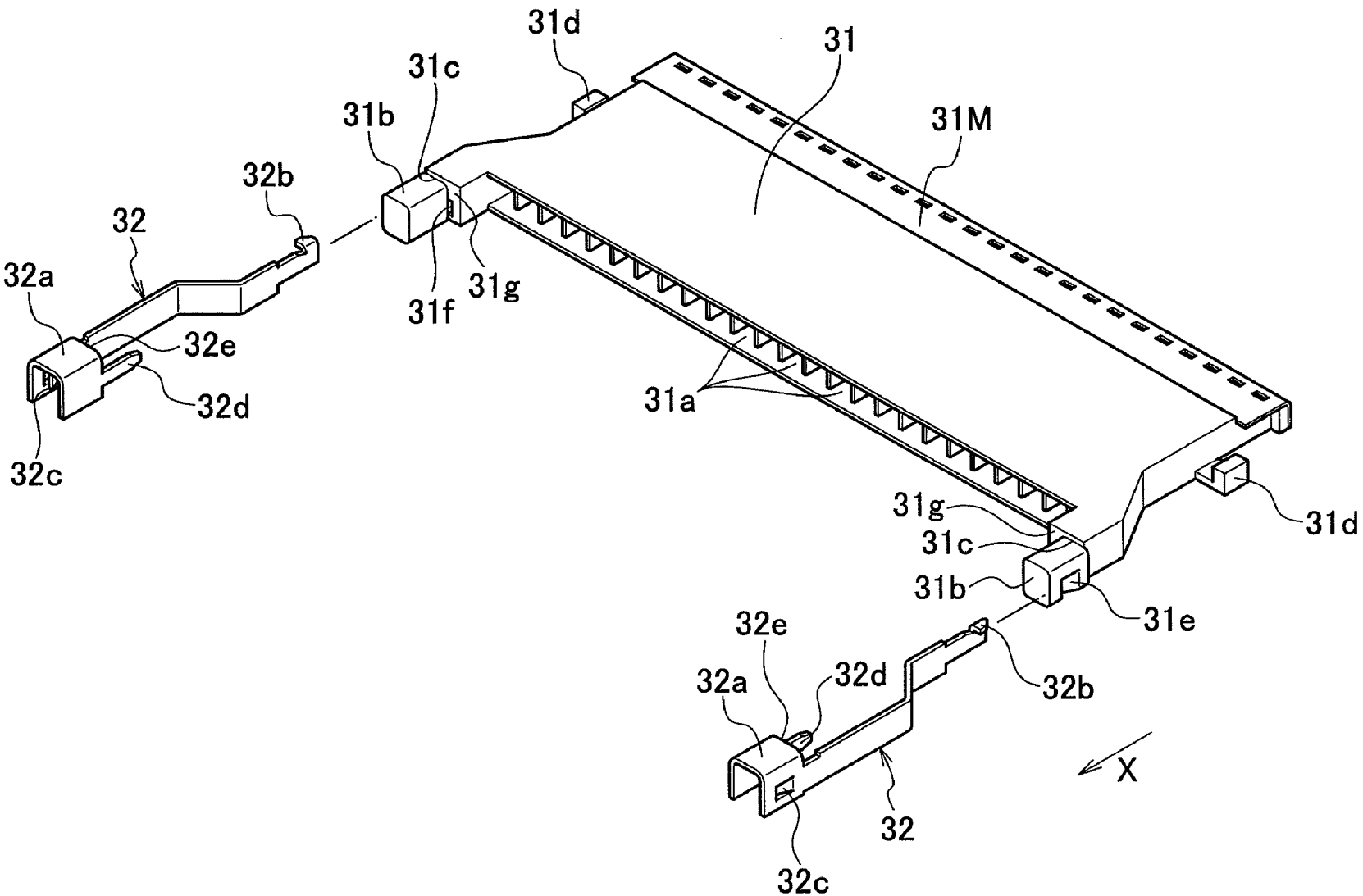
FIG. 7 is an exploded perspective view of the housing block as the coaxial cable connecting body of the multi-pole coaxial connector according to the embodiment.
Figure 8:
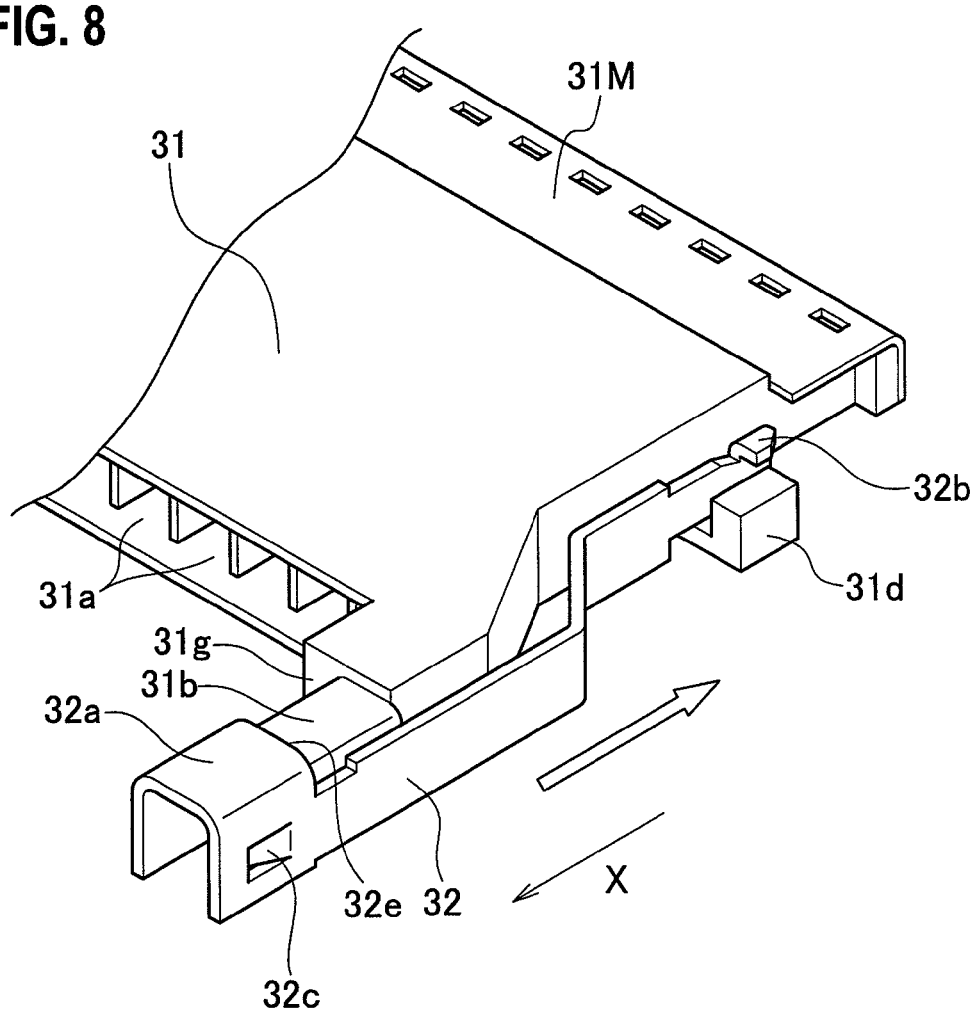
FIG. 8 is a perspective view of relevant parts of a state where lock arms are mounted on the housing block as the coaxial cable connecting body of the multi-pole coaxial connector according to the embodiment as viewed from outside.
Figure 9:
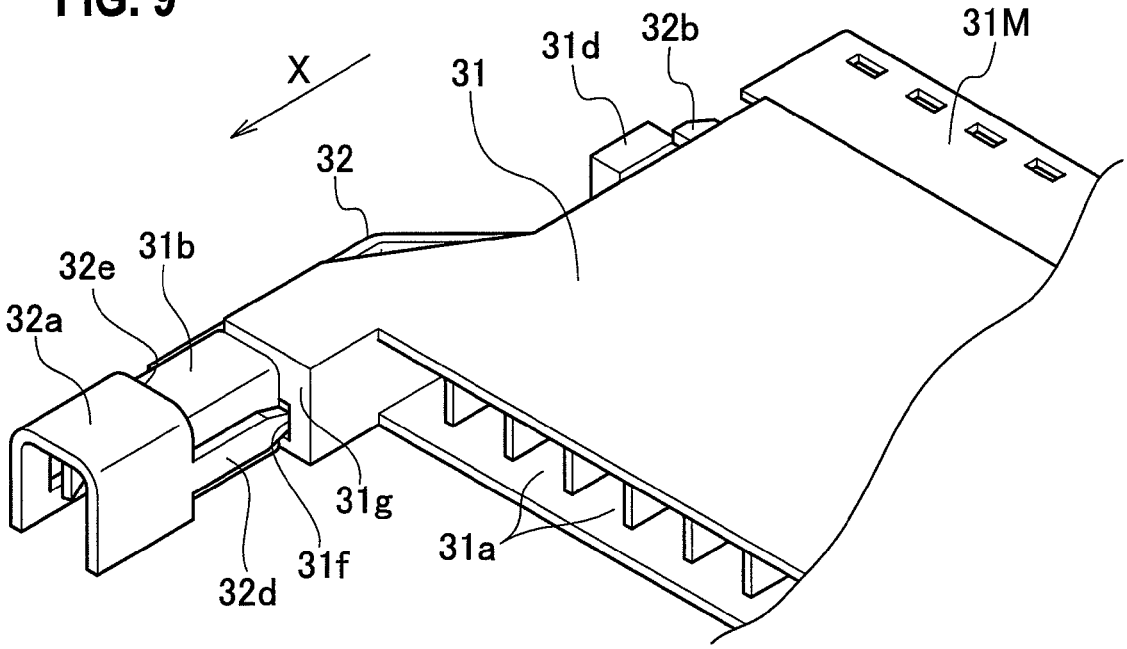
FIG. 9 is a perspective view of relevant parts of a state where the lock arms are mounted on the housing block as the coaxial cable connecting body of the multi-pole coaxial connector according to the embodiment as viewed from inside.

FIG. 7 is an exploded perspective view of the housing block. FIG. 8 is a perspective view of relevant parts of a state where the lock arms are mounted on the housing as viewed from outside. FIG. 9 is a perspective view of relevant parts of a state where the lock arms are mounted on the housing as viewed from inside.

As shown in FIG. 7, the housing 31 as a main body of the housing block 3 is formed into the substantially rectangular thin plate shape made of synthetic resin, and the plurality of insertion through holes 31*a* penetrating in the shorter direction (a left lower direction and a right upper direction in FIG. 7) are formed in the longitudinal direction (a left upper direction and a right lower direction in FIG. 7). A mounting projection 31*b* of the lock arm 32 projecting in the front side in the inserting direction of the coaxial cable 2 (=separating direction; X direction) is formed in each of both ends of the housing 31 in the longitudinal direction. A step 31*c* is formed on a root of the mounting projection 31*b*, and the mounting projection 31*b* is thinner than the main body side of the housing 31 in the thickness direction by the step 31*c*.

Guides 31*d* of the lock arms 32 are formed on both ends of the housing 31 in its longitudinal direction. A locking recess 31*e* is formed on an outer surface of the mounting projection 31*b*. An insertion hole 31*f* is formed in the mounting projection 31*b* on the side of the main body along an inner surface of the mounting projection 31*b*. The insertion hole 31*f* is opened in a separating direction (X direction in FIG. 7) of the housing block 3 from the receptacle 4.

The lock arm 32 is bent in a substantially crank shape along a shape of both end edge of the housing 31 in the longitudinal direction. A fitting unit 32*a* having a reversed U-shaped cross section astride an upper side of the mounting projection 31*b* is formed on a base end (front end) of the lock arm 32. An engaging unit 32*b* that is engaged with the receptacle 4 is formed on a tip end (rear end) of the lock arm 32. A cut and rising pawl 32*c* that is engaged with the locking recess 31*e* is formed on an outer surface of the fitting unit 32*a*. A tongue piece 32*d* that is press-fitted into the insertion hole 31*f* project from an inner surface of the fitting unit 32*a*.

As shown in FIGS. 8 and 9, the lock arms 32 abut against both end edges of the housing 31 in the longitudinal direction and pushed rearward, the fitting unit 32*a* is put on the mounting projection 31*b*, a tip end thereof is guided by the guide 31*d* and moved rearward, the tongue piece 32*d* is press-fitted into the insertion hole 31*f*, and the cut and rising pawl 32*c* is locked to the locking recess 31*e*. That is, in the present embodiment, the insertion hole 31*f* corresponds to a lock arm press-fit hole.

In a state where the mounting operation of the lock arms 32 to the housing 31 is completed, as shown in FIGS. 1 and 3, a rear end surface 32*e* of the fitting unit 32*a* of the lock arm 32 abut against a front end surface 31*g* of the step 31*c*. The front end surface 31*g* corresponds to a collision surface of the present invention, the front end surface 31*g* substantially faces a direction (X direction in FIGS. 8 and 9) in which the housing block 3 is separated from the receptacle 4 (fitting state is released). In other words, the normal direction of the front end surface 31*g* substantially matches with the separating direction (X direction).

In the present embodiment, the tongue piece 32*d* of the lock arm 32 shown in FIGS. 8 and 9 is press-fitted into the insertion hole 31*f* until the rear end surface 32*e* abuts against the front end surface 31*g*.

Figure 10:
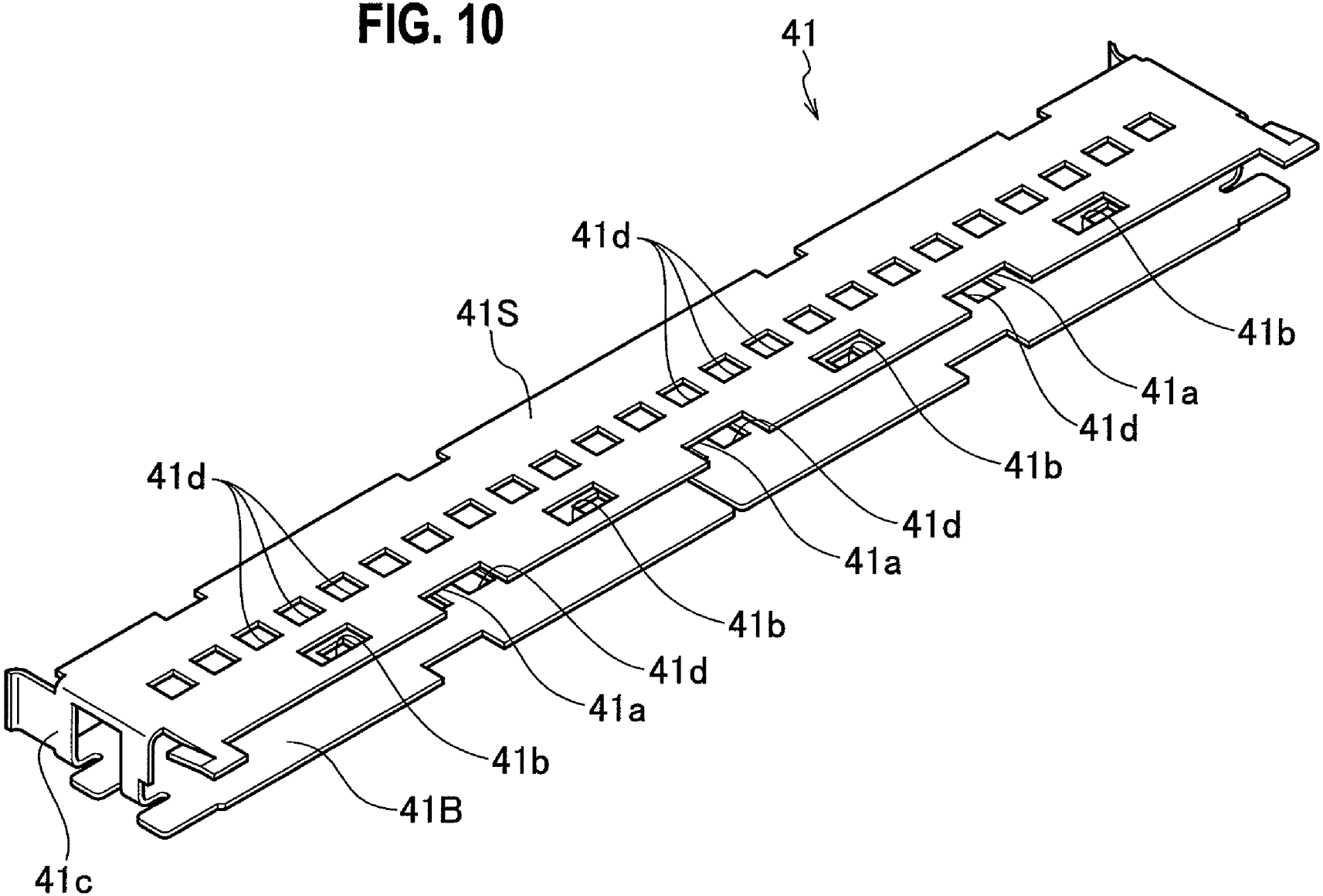
FIG. 10 is a perspective view of a shell included in the receptacle as the stationary side connecting body of the multi-pole coaxial connector according to the embodiment.
Figure 11:
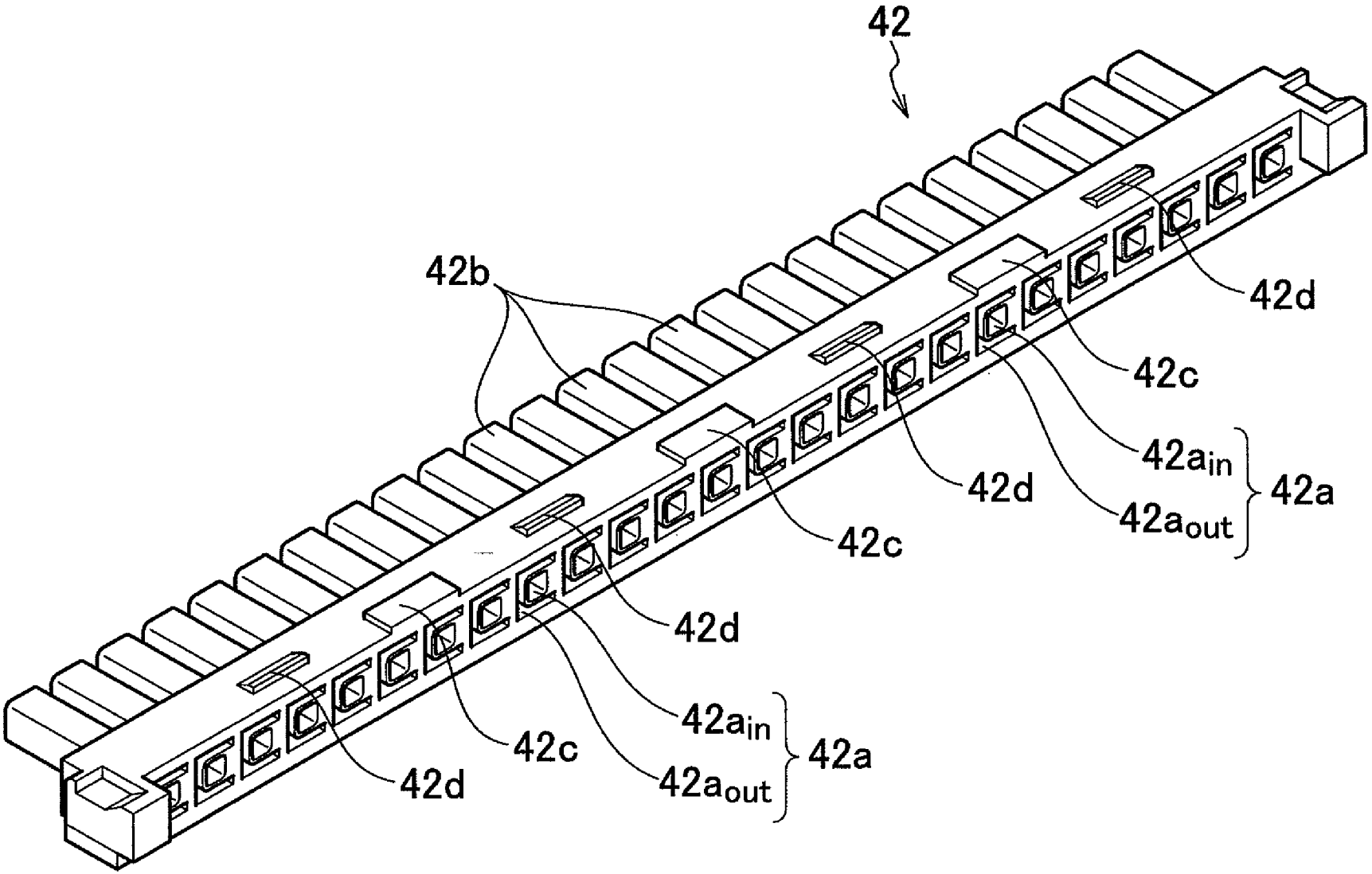
FIG. 11 is a perspective view of an insulating body included in the receptacle as the stationary side connecting body of the multi-pole coaxial connector according to the embodiment.
Figure 12:
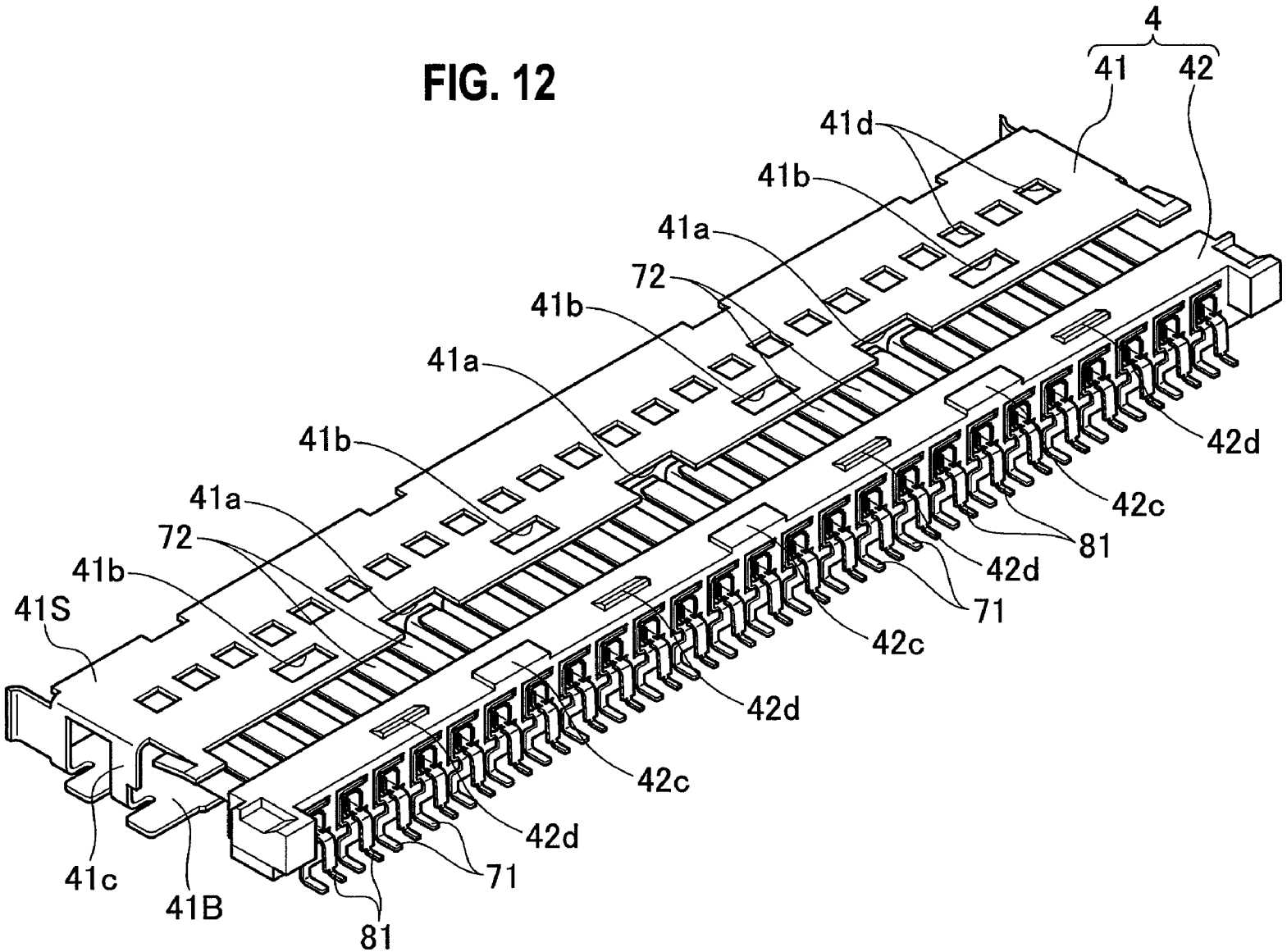
FIG. 12 is a perspective view of a state where the insulating body and the shell included in the receptacle as the stationary side connecting body of the multi-pole coaxial connector according to the embodiment are assembled together.

FIG. 10 is a perspective view of a shell provided on the receptacle. FIG. 11 is a perspective view of an insulating body provided on the receptacle. FIG. 12 is a perspective view showing a state where the shell and the insulating body are assembled.

As shown in FIG. 10, the shell 41 is formed into a hollow shape by bending a band-like metal plate into a flat rectangular cross section. A plurality of notches 41*a* is formed in a rear edge of an upper surface of the shell 41, and a substantially rectangular engaging hole 41*b* is formed between the notches 41*a*.

Engaging pieces 41*c* with which tip end engaging units 32*b* (see FIG. 7) of the lock arms 32 are locked are provided between an upper surface and a lower surface of the shell 41 on both ends of the shell 41 in its longitudinal direction.

As shown in FIG. 11, the insulating body 42 is formed as a resin block formed therein with a plurality of insertion shapes 42*a* having rectangular cross sections. Each insertion shape 42*a* has a double structure including an outer hole 42*a*out and an inner hole 42*a*in. The outer hole 42*a*out has a substantially U-shaped cross section, and the inner hole 42*a*in has a rectangular cross section. A cylindrical portion 42*b* connected to a partition wall between the outer hole 42*a*out and the inner hole 42*a*in project forward from a front (left upper side in FIG. 11) thereof.

A substantially rectangular positioning projection 42*c* which is fitted into the notch 41*a* when it is fitted into the shell 41 project from an upper surface of a rear end of the insulating body 42, and a detent pawl 42*d* which is engaged with an engaging hole 41*b* of the shell 41 project therefrom.

As shown in FIG. 12, the receptacle 4 is formed by fitting the entire insulating body 42 into the shell 41 in a state where the ground case 7 and the signal contact 8 are fitted into the insertion shape 42*a* of the insulating body 42.

As shown in FIG. 1, the receptacle 4 is fitted to the rear end of the housing block 3, the signal post 5 and the signal contact 8 are brought into conduction through the contact piece 83 and the ground contact 6 and the ground case 7 are brought into conduction through contact pieces 63 and 72 as shown in FIG. 2. With this structure, the internal conductor 21 of the coaxial cable 2 and the signal SMD terminal 81 are brought into conduction, and the external conductor 23 and the ground SMD terminal 71 are brought into conduction.

As shown in FIG. 1, when the receptacle 4 and the housing block 3 forming the multi-pole coaxial connector 1 are fitted to each other, the tip end engaging unit 32*b* of the lock arm 32 is locked to the engaging piece 41*c* of the shell 41, and the housing block 3 and the receptacle 4 are prevented from being pulled out from each other.

A producing method of the housing block 3 as the multi-pole coaxial cable connecting body, a producing method of poles mounted to the housing block 3 as a common portion (sub-assembly of conductive material including coaxial cable) will be specifically explained.

Figure 21A:
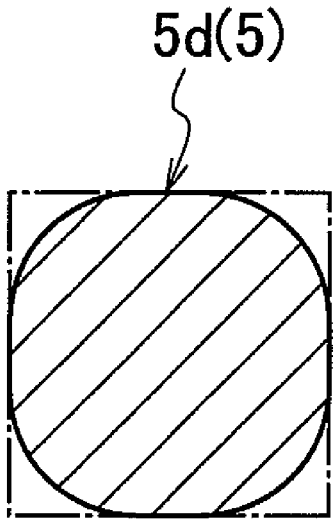
FIGS. 21A and 21B are sectional views of the signal post included in the housing block as the coaxial cable connecting body according to the embodiment, where

FIGS. 13A to 13E are explanatory diagrams showing producing steps of a sub-assembly of a coaxial cable and a conductive material included in the housing block in the order of 13A to 13E. FIGS. 14A to 14C are perspective views showing an assembling procedure of two conductive materials and a coaxial cable in the order of 14A to 14C. FIG. 21A is a sectional view taken along the line XXI-XXI in FIG. 13.

In the present embodiment, as described above, the housing block 3 includes the signal post 5 connected to the internal conductor 21 of the coaxial cable 2 as the conductive material, and the ground contact 6 which is fitted over the signal post 5 through an insulating block 51 made of synthetic resin as an insulator and which is connected to the external conductor 23 of the coaxial cable 2 (see FIG. 2).

These conductive materials (signal post 5 and ground contact 6) are formed by unreeling hoops 100 and 101 around which band-like metal members are reeled up (see FIGS. 13A to 13E), and sequentially working the unreeling portions of the hoops 100 and 101.

Figure 13:
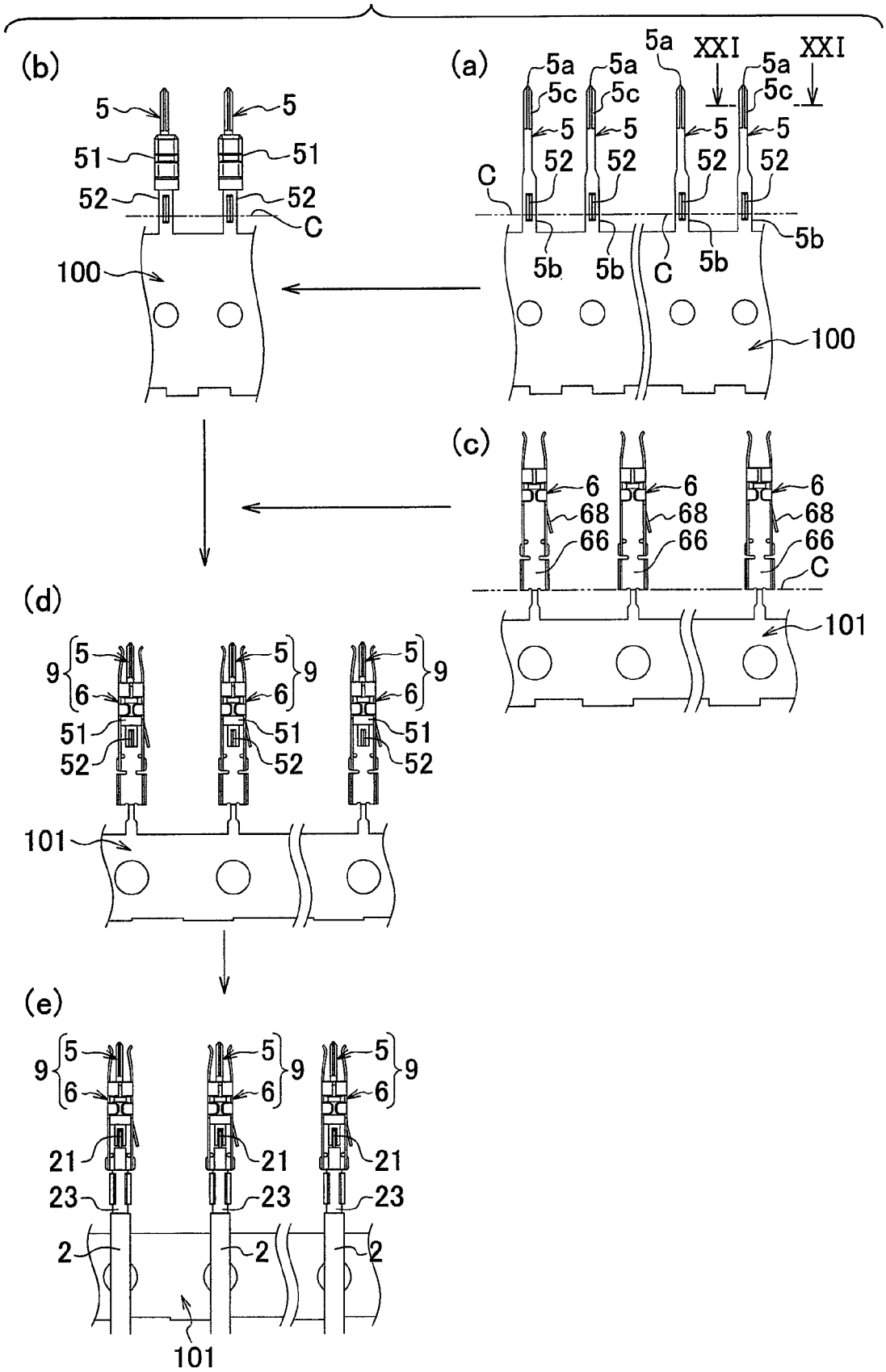
FIGS. 13A to 13E are explanatory diagrams showing producing steps of a sub-assembly of a coaxial cable and a conductive material included in the housing block as the coaxial cable connecting body of the multi-pole coaxial connector according to the embodiment in the order of 13A to 13E.

First, as shown in FIG. 13(*a*), the hoop 100 is press formed, thereby forming a plurality of signal posts 5 on one side of the hoop 100 in its widthwise direction in a state where one ends of the signal posts 5 in the longitudinal direction are connected to each other. The signal posts 5 are formed in such an attitude that the signal post 5 project at a predetermined pitch along the widthwise direction of the hoop 100 (substantially at right angles with the extending direction of the hoop 100) (first hoop forming step).

Next, as shown in FIG. 13(*b*), an insulating block (dielectric block) 51 made of insulator (e.g., insulating resin) is fixed to a predetermined portion of the signal post 5 by insert molding in a state where the plurality of signal posts 5 are connected to the hoop 100) (insulator forming step).

On the other hand, as shown in FIG. 13(*c*), the other hoop 101 is press formed, and a plurality of ground contacts 6 are formed on one side of the hoop 101 in its widthwise direction in a state where one ends of the ground contacts 6 in the longitudinal direction are connected to each other (second hoop forming step).

Next, as shown in FIG. 13(*d*), the signal posts 5 and the ground contacts 6 respectively connected to the corresponding hoops 100 and 101 are mutually assembled, and the assembly blocks 9 are formed. At this time, as shown in FIGS. 14A and 14B also, the insulating block 51 is fixed to the periphery of the signal post 5, and the signal post 5 is fitted in a state where the insulating block 51 is interposed in the ground contact 6 having the substantially U-shaped cross section (assembling step).

After this assembling step, the signal post 5 is separated from the hoop 100. In the present embodiment, the ground contact 6 is not separated from the hoop 101 at this stage. However, the assembly block 9 is still connected to the hoop 101 (first hoop separating step).

Next, as shown in FIG. 13(*e*), in a state where it is connected to the hoop 101, the coaxial cable 2 is connected to the assembly block 9. More specifically, the internal conductor 21 of the coaxial cable 2 is connected to the signal post 5, and the external conductor 23 is connected to the ground contact 6 (coaxial cable connecting step).

Next, although not shown, the sub-assembly of the coaxial cable 2 and the assembly block 9 is inserted into the housing block 3 (see FIG. 5). To make it easy to handle the sub-assembly, it is preferable that the ground contact 6, i.e., the sub-assembly of the coaxial cable 2 and the assembly block 9 is separated from the hoop 101 immediately before this step is carried out (second hoop separating step).

In the first hoop forming step for forming the signal post 5, as shown in FIG. 13(*a*) and FIG. 14A, a notch 52 having a V-shaped cross section is formed in a base end 5*b* which is a connecting portion of the internal conductor 21 of the coaxial cable 2. This notch 52 becomes the connection with respect to the internal conductor 21 and thus, it is preferable that the notch 52 is formed in a roll surface (front or back surface) of the hoop 100 having high surface precision (surface roughness is low).

At the same time, in the first hoop forming step, as shown in FIG. 21A, corners of a cross section of polygonal shape of a tip end 5*c* of the signal post 5 are chamfered so that a peak 5*a* is pointed.

In the first hoop forming step, the base end 5*b* of the signal post 5 is formed with a shallow groove extending in the widthwise direction of the signal post 5. This groove portion becomes a cut portion C in the first hoop separating step.

In the insulator forming step, as shown in FIG. 14A, protrusions 51*a* and 51*b* protrude from an upper surface of the insulating block 51 at a predetermined distance from each other in the longitudinal direction.

Meanwhile, in the second hoop forming step for forming the ground contact 6, as shown in FIG. 14A, the ground contact 6 includes a bottom 61 and both side surfaces 62 and the ground contact 6 is bent into U-shape in cross section. A pair of contact pieces 63 with respect to the ground case 7 project from both sides of its tip end, and a pair of stationary pawl pieces 64 and 65 of the insulating block 51 project upward from both sides of roots of the contact pieces 63. The base side of the ground contact 6 is a swaging unit 66 for fixing the external conductor 23 of the coaxial cable 2. A pair of stationary pawl pieces 67 is provided on both sides of the swaging unit 66. As shown in FIG. 13(*c*), the cut portion C is set on a root of the hoop 101.

In FIGS. 14A to 14C, for convenience sake, the assembly block 9 on the opening side of the ground contact 6 is directed upward, but when the sub-assembly of the assembly block 9 and the coaxial cable 2 is actually assembled into the housing 31, the opening side of the ground contact 6 is in the side-by-side direction of the coaxial cable 2, i.e., in the lateral direction as shown in FIGS. 4 and 5. Therefore, the pair of contact pieces 63 is disposed in the vertical direction as shown in FIG. 2.

That is, the ground contact 6 is formed into substantially a U-shaped in cross section in which the side of the adjacent ground contacts 6 is opened. More specifically, the ground contact 6 is formed into U-shape in cross section by the bottom surface 61 and both the side surfaces 62, and the portion thereof which is not provided with the bottom surface 61 and the side surfaces 62 are opened, but the opened side is substantially closed by the bottom surface 61 of the adjacent ground contacts 6.

The swaging unit 66 of the ground contact 6 is formed into U-shape in cross section surrounding outside of the external conductor 23 except on the side of the adjacent ground contacts 6 so that a swaging force in a direction different from the side-by-side direction of the ground contacts 6 (the intersecting direction in the present embodiment) is applied between the stationary pawl pieces 67 opposed to each other in the swaging unit 66. More specifically, the swaging unit 66 is formed into U-shape in cross section like the main body of the ground contact 6 by the extension of the bottom 61 and the stationary pawl pieces 67, and a portion thereof not provided with the extension of the bottom 61 and the stationary pawl pieces 67 becomes the opening side, and this opening side is substantially closed by the bottoms 61 of the adjacent ground contacts 6.

At this time, the opposed surface of the pair of contact pieces 63 become a surface of the hoop 101. Elastic force is applied in a direction in which the pair of contact pieces 63 approach each other, and when the housing block 3 and the receptacle 4 are coupled to each other, the contact pieces 63 are inserted into the receptacle 4 and the repulsion force is generated in front and back directions.

A cut and rise piece 68 (see FIG. 4) in which tip end side is connected outwardly projects from one of side surfaces 62 of the ground contact 6, and when the assembly block 9 is inserted into the insertion hole 31*a* of the housing 31, the cut and rise piece 68 bites into the inner surface of the insertion hole 31*a* to prevent it from being pulled out.

In the assembling step in which the signal post 5 and the ground contact 6 are assembled, as shown in FIG. 14A, the stationary pawl pieces 64 on the tip end side are bent inward, the signal post 5 having the insulating block 51 is inserted from back of the ground contact 6 (right in FIGS. 14A to 14C) and as shown in FIG. 14B, the tip end side protrusion 51*a* abuts against the stationary pawl piece 64.

Next, as shown in FIG. 14C, a tip end of the coaxial cable 2 from which the internal conductor 21 and the external conductor 23 are exposed is disposed in a substantially U-shaped recess in the ground contact 6, the internal conductor 21 is fitted into the notch 52 of the signal post 5, and the internal conductor 21 and the signal post 5 are connected to each other.

Thereafter, the stationary pawl pieces 65 are bent in a direction in which they approach each other and they are swaged, a recess 51*c* between front and back protrusions 51*a* and 51*b* is pressed, the stationary pawl pieces 67 on the side of the base of the ground contact 6 are bent in a direction in which they approach each other and they are swaged and soldered, and the external conductor 23 of the coaxial cable 2 is pressed, thereby connecting the external conductor 23 and the ground contact 6 to each other. In this state, the sub-assembly of the coaxial cable 2 and the assembly block 9 is formed.

Figure 16:
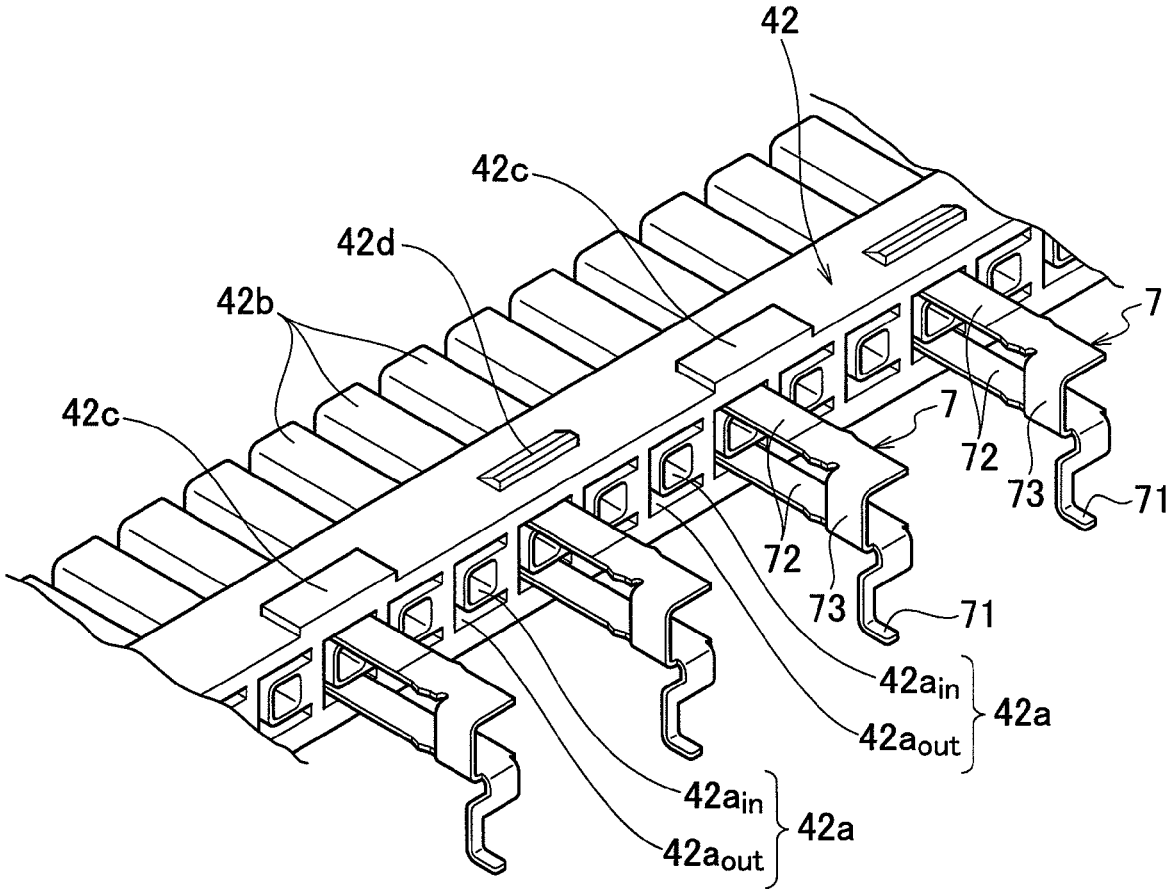
FIG. 16 is an enlarged perspective view of an assembling step of a ground case included in the receptacle as the stationary side connecting body of the multi-pole coaxial connector according to the embodiment.
Figure 17:
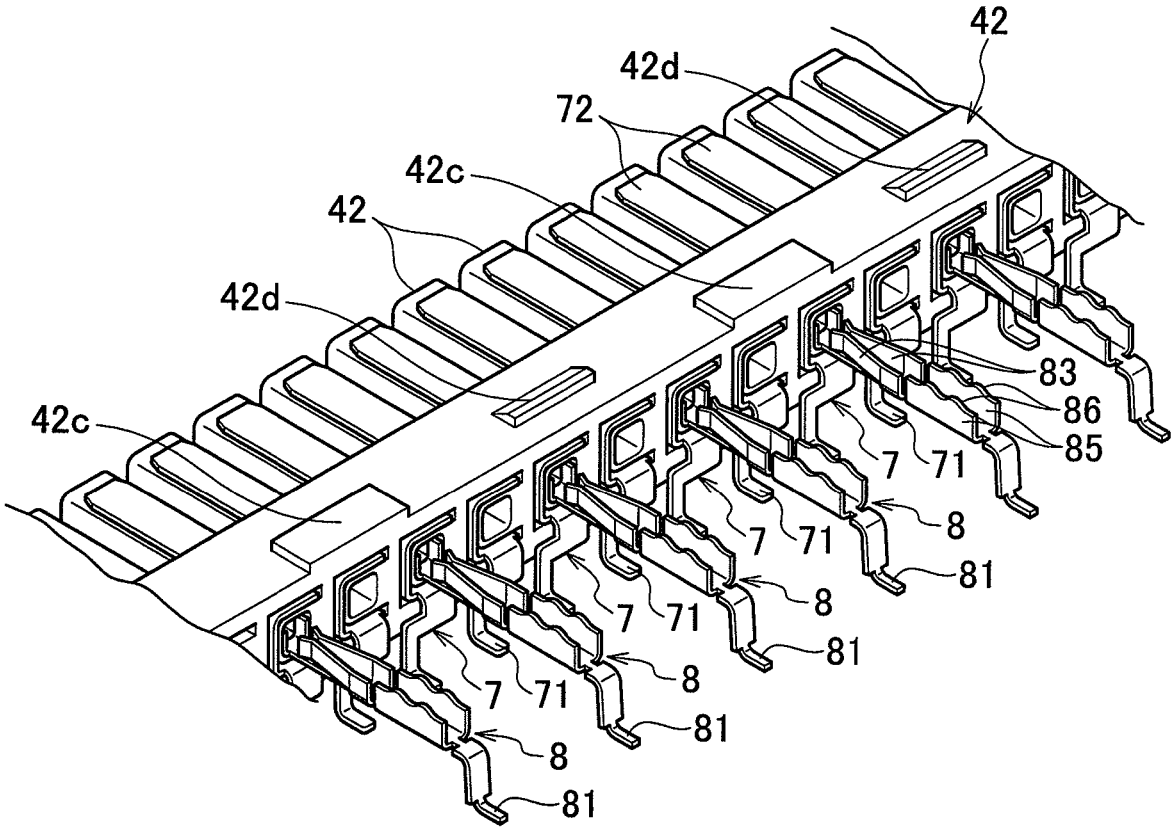
FIG. 17 is an enlarged perspective view of an assembling step of a signal contact included in the receptacle as the stationary side connecting body of the multi-pole coaxial connector according to the embodiment.

Next, a producing method of the receptacle 4 as a second connecting body will be explained. FIGS. 15A to 15E are explanatory diagrams of producing steps of the receptacle in the order of 15A to 15E. FIG. 16 is an enlarged perspective view of an assembling step of the ground case. FIG. 17 is an enlarged perspective view of an assembling step of the signal contact.

In the present embodiment, as described above, the ground case 7 which is fitted to the insulating body 42 and which has the ground SMD terminal 71, and the signal contact 8 which is fitted into the ground case 7 in a non-contact manner and which has the signal SMD terminal 81 are included in the receptacle 4 (see FIG. 2).

These conductive materials (ground case 7 and the signal contact 8) are formed by reeling up hoops 102 and 103 (see FIGS. 15A to 15E) obtained by reeling band-like metal members, and the reeled up portions of the hoops 102 and 103 are sequentially worked.

Figure 15:
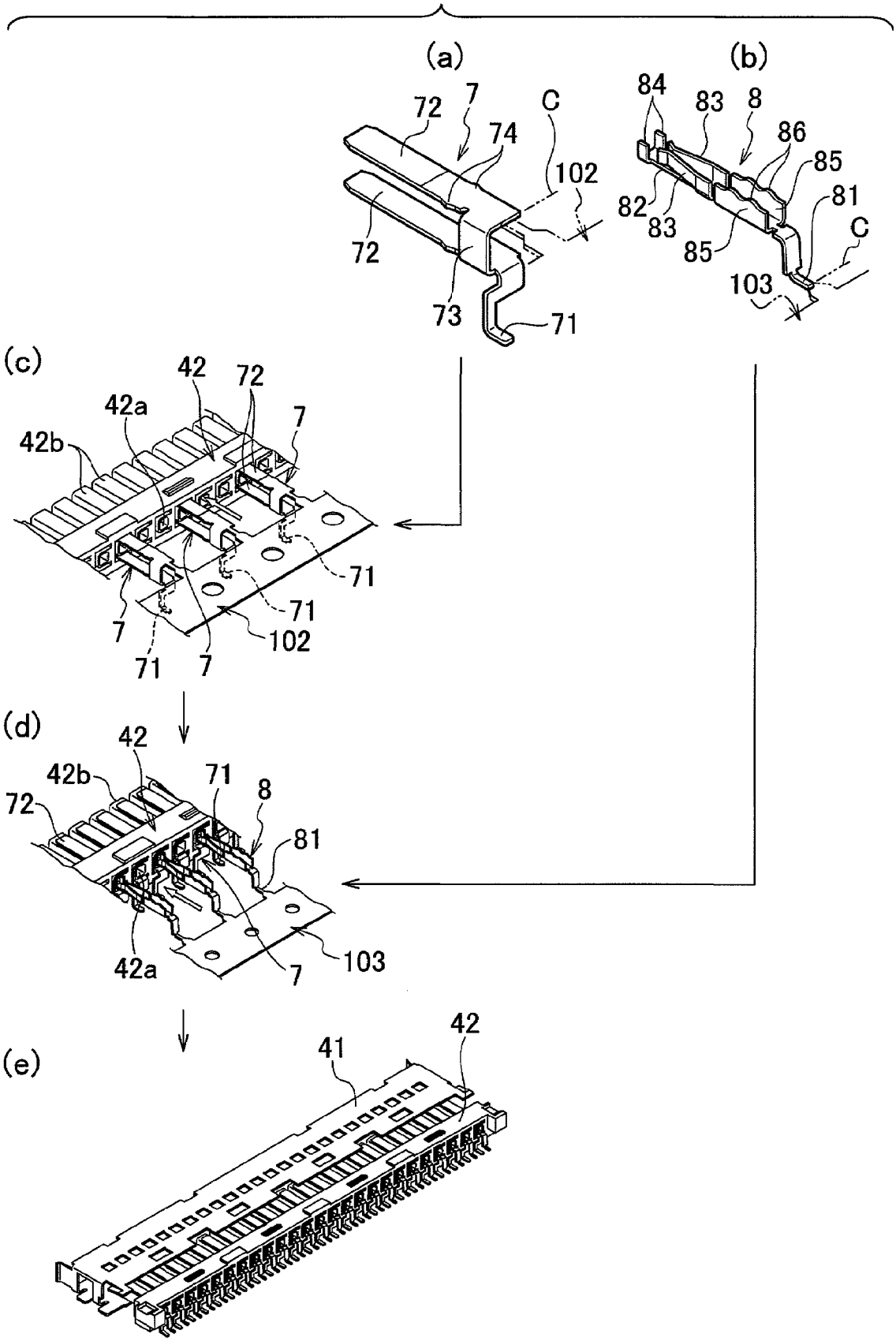
FIGS. 15A to 15E are explanatory diagrams of producing steps of the receptacle as the stationary side connecting body of the multi-pole coaxial connector according to the embodiment in the order of 15A to 15E.

First, as shown in FIG. 15(*a*), the ground case 7 is press-formed in a state where a portion of the ground case 7 is connected to one side of the hoop 102.

As shown in FIG. 15(*b*), the signal contact 8 is press-formed in a state where a portion of the signal contact 8 is connected to one side of the hoop 103.

Next, as shown in FIG. 15(*c*), the ground case 7 is fitted to the insulating body 42 in a state where the ground case 7 is connected to the hoop 102 and then, as shown in FIG. 15(*d*), the signal contact 8 is fitted into the ground case 7 in a state where the signal contact 8 is connected to the hoop 103. Although the hoop 102 is omitted in FIG. 16 for the convenience sake, the ground case 7 is connected to the hoop 102 at this stage.

The ground case 7 and the signal contact 8 are assembled to the insulating body 42 and then, they are separated from the hoops 102 and 103 and as shown in FIG. 15(*e*), and the shell 41 is fitted to the insulating body 42 and the receptacle 4 is obtained.

As shown in FIG. 15(*a*), the ground case 7 includes a pair of contact pieces 72 opposed to front and back directions of the receptacle 4, and a connecting piece 73 which connects one sides of bases of the contact pieces 72 to each other.

The ground case 7 is formed into substantially U-shape in cross section in which the adjacent side of the ground case 7 is opened.

The ground SMD terminal 71 is integrally formed with an end of one of the contact pieces 72 (lower one in FIG. 15) in the longitudinal direction, a base end of the contact piece 72 is bent in substantially perpendicular direction at right angles to form an upper half 71*a*, and it is further bent in a form of a crank and then, it is bent in the extending direction of the contact piece 72, and a narrowed tip end 71*b* is project substantially in parallel to the contact piece 72. In the ground case 7, a base portion of the other contact piece 72 (upper one in FIG. 15) is connected to the hoop 102, and the cut portion C is set at that portion.

As shown in FIG. 2, the contact pieces 63 of the ground contacts 6 comes into contact with outer wall surfaces of the contact piece 72 in the front and back directions (i.e., front and back directions of the receptacle 4) which become the contact surface of the ground case 7 under predetermined pressing force. At this time, the outer wall surface (contact surface with the contact pieces 63) is preferably a roll surface (front or back surface) of the hoop 102 having high surface precision (surface roughness is low).

As shown in FIG. 15(*a*), sawtooth portions 74 which bite into left and right inner sides of the insertion shape 42*a* (see FIG. 11) of the insulating body 42 made of synthetic resin are formed on both sides of base sides at which the contact pieces 72 are fitted to the insulating bodies 42, and the sawtooth portion 74 has a detent function.

As shown in FIG. 15(*b*), the signal contact 8 includes a bottom surface 82 extending in the longitudinal direction, a pair of contact pieces 83 to which repulsion forces are applied in a direction opposed to each other, a pair of guide pieces 84 which upwardly bend both sides of a tip end of the bottom surface 82, and a pair of fitting pieces 85 which upwardly bend both sides of a base end of the bottom surface 82 in the widthwise direction.

When the housing block 3 and the receptacle 4 are coupled to each other, the signal post 5 is inserted between the pair of contact pieces 83, the contact pieces 83 sandwich the outer side of the signal post 5 and an excellent contact state can be obtained.

The signal SMD terminal 81 is formed integrally with an end of the bottom surface 82 in the longitudinal direction, the signal SMD terminal 81 is bent in a form of a crank, thereby forming a step between the bottom surface 82 and the tip end, and the narrowed tip end projects in the extending direction of the bottom surface 82. At this time, a tip end of the signal SMD terminal 81 is connected to the hoop 103, and the cut portion C is set at the tip end of the signal SMD terminal 81.

The fitting pieces 85 are formed at their tip end edges with sawtooth portions 86 which bite into an upper inner side of the insulating body 42, and the sawtooth portions 86 have detent functions.

As shown in FIG. 15(*c*), when the ground case 7 is fitted to the insulating body 42, the ground case 7 is first inserted into the outer hole 42*a*out having substantially U-shaped cross section of the insertion shape 42*a* as shown in FIG. 16. In a state where the ground case 7 is completely inserted, as shown in FIG. 17, the pair of contact pieces 72 are exposed from the outer hole 42*a*out on the deep side in the inserting direction, and the contact pieces 72 are in intimate contact with front and back surfaces of the cylindrical portion 42*b*.

After the ground case 7 is fitted, as shown in FIG. 17, the signal contact 8 is inserted into the inner hole 42*a*in of the insertion shape 42*a*, and the pair of contact pieces 83 are located in the cylinder of the cylindrical portion 42*b*. That is, the non-contact state (insulated state) between the ground case 7 and the signal contact 8 is maintained by the cylindrical portion 42*b*.

In the present embodiment, opening and closing directions of the pair of contact pieces 63 of the ground contact 6 and opening and closing directions of the pair of contact pieces 83 of the signal contact 8 are different from each other.

That is, as shown in FIGS. 2 and 5, the pair of contact pieces 63 of the ground contact 6 are opposed to each other in the vertical direction in FIGS. 2 and 5 (i.e., front and back directions of the receptacle 4), and the pair of contact pieces 83 of the signal contact 8 are opposed to each other in a direction perpendicular to the former direction (arrangement direction of the coaxial cable 2). That is, in the present embodiment, opening and closing directions of the pair of contact pieces 63 of the ground contact 6 and opening and closing directions of the pair of contact pieces 83 of the signal contact 8 intersect with each other at right angles.

In the present embodiment, a contact portion of the ground case 7 (pair of contact pieces 72) sandwiched between the pair of contact pieces 63 of the ground contact 6 is formed into a flat-plate like shape.

That is, as shown in FIG. 15(*a*), in the ground case 7, the pair of contact pieces 72 are arranged in parallel to each other such that they are opposed in the vertical direction, but the contact pieces 72 are in a flat plate state in which they are punched from the hoop 102, and the contact pieces 72 are not curved nor bent.

In the present embodiment, the opening and closing directions of the pair of contact pieces 63 of the ground contact 6 are front and back directions of the receptacle 4, and as shown in FIGS. 10 and 12, both front surface 41S and back surface 41B of the receptacle 4 (shell 41 thereof) are formed with holes to evade interference 41*d* of the contact pieces 63.

In the present embodiment, the multi-pole coaxial connector 1 is multi-polarized and conduction of the plurality of coaxial cables 2 is secured. At this time, in the present embodiment, as shown in FIGS. 13 and 15, a pitch of the hoops 100 to 103 corresponding to the signal post 5, ground contact 6 ground case 7 and signal contact 8 is integral multiple (an integer of one or more) of terminal pitch of the multi-pole coaxial cable 2 (i.e., pitch P of the insertion holes 31*a* and 42*a* of the housing 31 and the insulating body 42).

Figure 18:
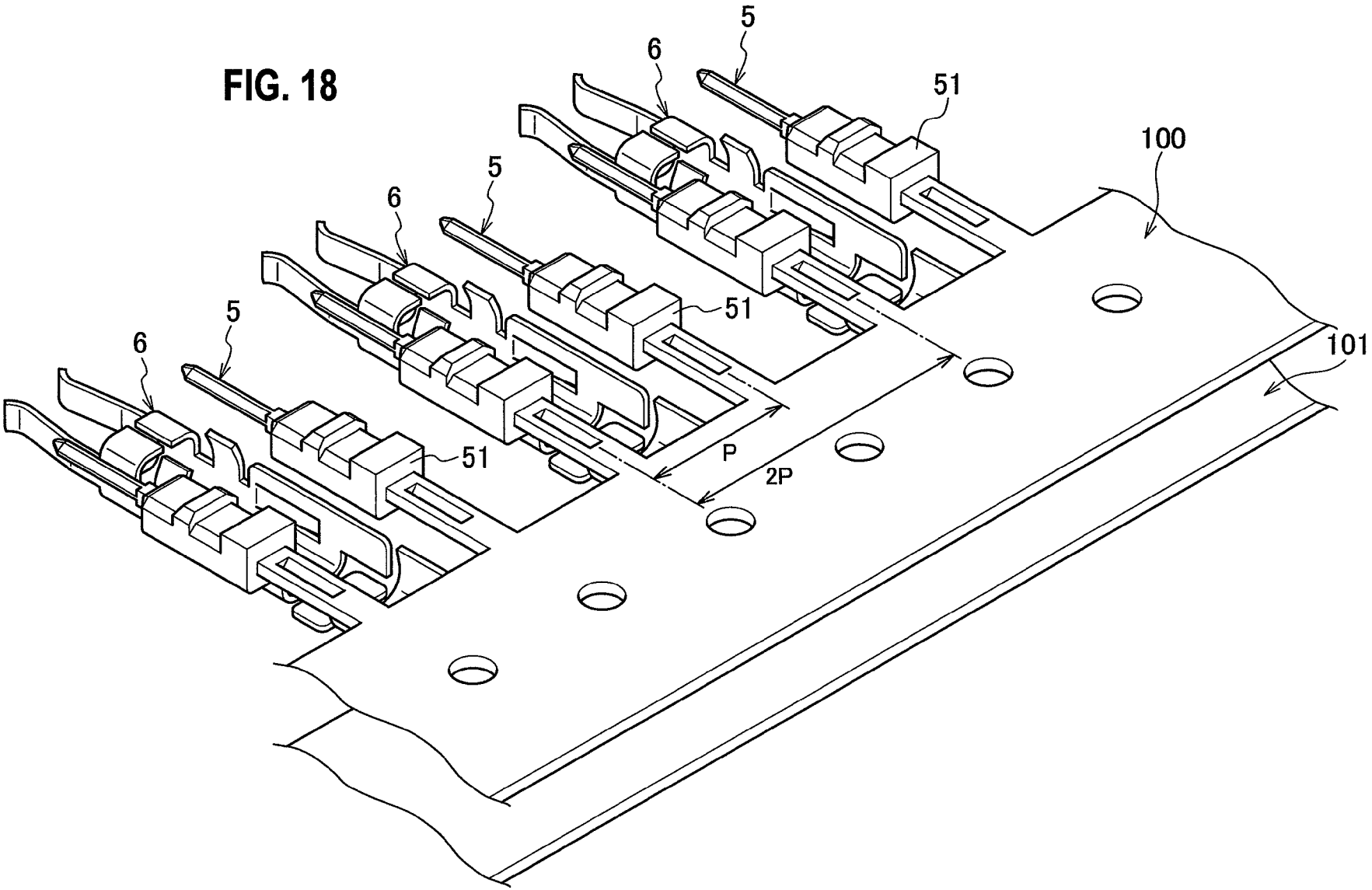
FIG. 18 is an enlarged perspective view showing an assembling step of a signal post and the ground contact included in the housing block as the coaxial cable connecting body of the multi-pole coaxial connector according to the embodiment.

The case of the present embodiment will be explained with reference to FIG. 18. FIG. 18 is an enlarged perspective view of assembling step of the signal post and the ground contact. In the case of FIG. 18, the signal posts 5 are formed with the same pitch P as the one terminal pitch P (i.e., one time of the terminal pitch P), and the ground contacts 6 are formed with a pitch P2 (i.e., two times of the terminal pitch P).

In this case, as shown in FIG. 18, the plurality of signal posts 5 formed on the hoop 100 with the predetermined pitch (P) are assembled to the plurality of ground contacts 6 formed on the hoop 101 with the predetermined pitch (2P), and the assembled signal posts 5 are separated from the hoop 100. At this time, since the pitch (2P) of the ground contacts 6 is two times of the pitch (P) of the signal posts 5, the signal posts 5 of every other pitch (2P) remain on the hoop 100. Thus, in this case, although not shown in FIG. 18, the signal posts 5 remaining on the hoop 100 with the pitch (2P) can be assembled to the ground contacts 6 connected to a new (another hoop disposed downstream or side-by-side) hoop 101 with the same pitch (2P).

Concerning the conduction portion of the receptacle 4, as show in FIG. 15(*c*), the ground cases 7 are formed on the hoop 102 with a pitch (3P) which is three times of the terminal pitch P. As shown in FIG. 15(*d*), the signal contacts 8 are formed on the hoop 103 with the pitch (2P) which is two times of the terminal pitch P. Therefore, concerning the ground cases 7, three times assembling steps are carried out with respect to the insulating body 42 every four insertion shape 42*a*, and concerning the signal contacts 8, two times assembling steps are carried out every three insertion shapes 42*a*.

When the assembling step between the coaxial cable 2 and the assembly block 9 (see FIGS. 13 and 14), and the step for assembling the sub-assembly between the coaxial cable 2 and the assembly block 9 into the housing 31 to obtain the housing block 3 (see FIG. 5) are carried out at different places (equipment or factory), by transporting in the form of the sub-assembly in which a plurality of assembly blocks 9 and coaxial cables 2 are connected to the hoop 101, as shown in FIG. 13(*e*), it is possible to handle the plurality of assembly blocks 9 more easily.

Figure 19:
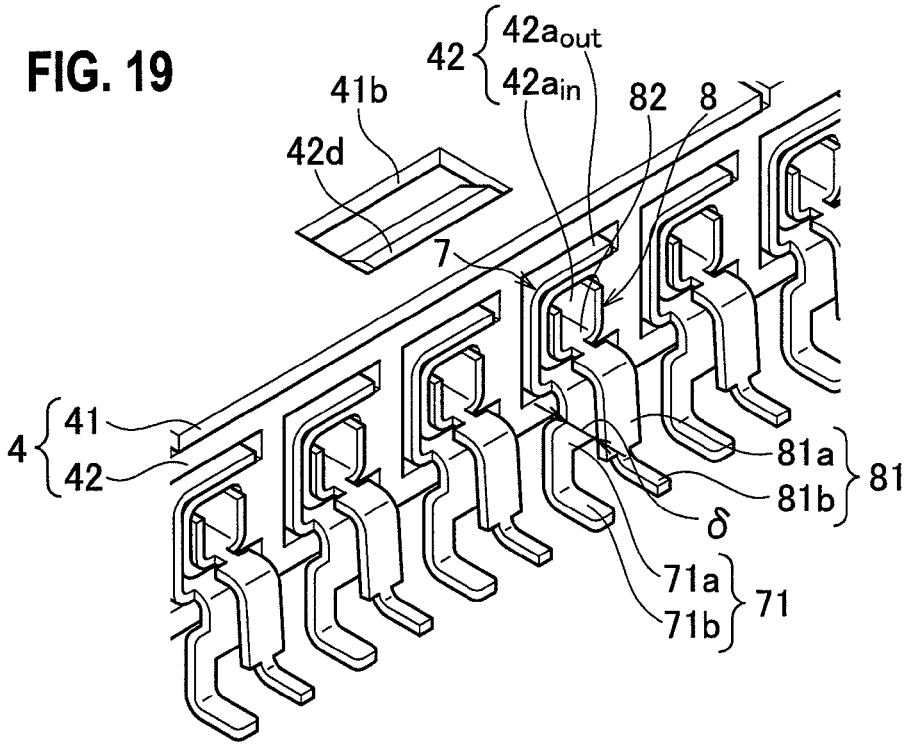
FIG. 19 is an enlarged perspective view of portions of a signal terminal and the ground terminal taken out from the receptacle as the stationary side connecting body of the multi-pole coaxial connector according to the embodiment.

FIG. 19 is an enlarged perspective view of portions of the signal SMD terminal and the grounding SMD terminal taken out from the receptacle.

As shown in FIG. 19, in the present embodiment, the signal SMD terminals 81 and the ground SMD terminals 71 project from the receptacle 4 in a state where their surface are opposed to each other at a predetermined distance δ.

More specifically, the upper half 81*a* of the signal SMD terminal 81 and the upper half 71*a* of the ground SMD terminal 71 are opposed to each other in the longitudinal direction substantially in parallel to each other, and a distance therebetween is δ.

The tip end of the upper half 71*a* of the ground SMD terminal 71 is bent sideway, the ground SMD terminal 71 bypasses the narrow tip end 81*b* of the signal SMD terminal 81, the tip end 81*b* and the tip end 71*b* of the ground SMD terminal 71 are arranged side-by-side in parallel to each other, and they are SMD mounted on a substrate (not shown).

According to the present embodiment, the ground contact 6 is formed into substantially U-shape in cross section which is opened on the side of the adjacent ground contact 6, and since a wall of the ground contact 6 does not exist on the opening side, the arrangement pitch of the ground contacts 6 can be reduced at least by the thickness of the wall. That is, since the ground contacts 6 can be disposed more compact, the housing block 3, the receptacle 4 connected to the housing block 3, and the multi-pole coaxial connector 1 having the housing block 3 and the receptacle 4 can further be reduced in size.

According to this structure, the opening side is substantially closed by the bottom 61 of the adjacent ground contact 6. Thus, the outer periphery of the signal post 5 is surrounded by the ground contact 6, noise can be reduced by the ground contact 6 and the mutual interference between signals can be suppressed.

According to the present embodiment, the swaging unit 66 of the ground contact 6 is formed into substantially U-shape in cross section surrounding outside of the external conductor 23 except on the side of the adjacent ground contact 6, a wall of the swaging unit 66 does not exist on the side of the adjacent ground contact 6 and thus, the arrangement pitch of the swaging unit 66 can be reduced at least by the thickness of the wall. That is, since the ground contacts 6 can be disposed more compact, the housing block 3, the receptacle 4 connected to the housing block 3, and the multi-pole coaxial connector 1 having the housing block 3 and the receptacle 4 can further be reduced in size.

According to the present embodiment, the ground case 7 is formed into substantially U-shape in cross section which is opened on the side of the adjacent ground case 7, a wall of the ground case 7 does not exist on the opening side and thus, the arrangement pitch of the ground case 7 can be reduced at least by the thickness of the wall. Thus, the receptacle 4, the housing block 3 coupled to the receptacle 4 and the multi-pole coaxial connector 1 having the housing block 3 and the receptacle 4 can further be reduced in size.

According to this structure, the opening side is substantially closed with the connecting piece 73 (partition wall) of the adjacent ground case 7. Since the outer periphery of the signal contact 8 is substantially surrounded by the ground case 7, noise can be reduced by the ground case 7, and mutual interference of signals can be suppressed.

Meanwhile, in a conventional coaxial connector disclosed in Japanese Patent Application Laid-open No. 2004-355932, a pair of contact pieces of the receptacle signal core line and a pair of contact pieces of a receptacle core line shield have the same sandwiching directions. Thus, an opening and closing margin of the pair of contact pieces of the receptacle signal core line and an opening and closing margin of the pair of contact pieces of a receptacle core line shield overlap each other in the same direction and as a result, widths of the coupled portions of the plug side and the receptacle side are increased and there is a problem that the coaxial connector is increased in size. Particularly, in the multi-pole coaxial connector in which a plurality of coaxial cables are arranged side-by-side, since the increased width of the coupled portions are accumulated in the side-by-side direction, the coaxial connector has to be further increased in size.

In this point, according to the present embodiment, however, since the opening and closing directions of the pair of contact pieces 63 of the ground contact 6 and the opening and closing directions of the pair of contact pieces 83 of the signal contact 8 are different from each other, it is possible to prevent the opening and closing margins from overlapping each other. Therefore, it is possible to prevent the coupled portion of both the housing block 3 and the receptacle 4 from increasing and the coaxial connector 1 can be reduced in size.

Furthermore, according to the present embodiment, the contact pieces 72 of the ground case 7 sandwiched between the pair of contact pieces 63 of the ground contact 6 are formed into flat-plate like shapes. With this structure, when the contact pieces 72 are produced, working for curving the band-like workpiece bland is unnecessary, the working of parts is facilitated and the producing cost can be reduced.

Further, according to the present embodiment, the clearance holes 41*d* that evade interference with the contact pieces 63 of the ground contact 6 are formed in the front surface 41S and the back surface 41B of the shell 41 of the receptacle 4. Therefore, the clearance holes 41*d* can be used as margin in bending range of the contact pieces 63, the receptacle 4 can further be thinned, and the coaxial connector 1 can be reduced in size. The clearance hole 41*d* can be provided one of the front surface 41S and the back surface 41B of the shell 41.

This effect is considerably remarkable in the multi-pole coaxial connector 1 as explained in the present embodiment. That is, if the opening and closing directions of the contact pieces 63 are the arrangement direction of the coaxial cable 2, it is necessary to increase the terminal pitch by the amount of the fitting margin in bending range of the contact piece 63 and the thickness of the insulating wall so that the contact pieces 63 do not come into contact with each other at the adjacent. However, according to this embodiment, the opening and closing directions of the contact pieces 63 are the front and back directions of the receptacle 4 (thickness direction), therefore it is unnecessary to take the short-circuit with other pole into account and thus, the insulating wall becomes unnecessary, and the clearance hole 41*d* can be provided and the connector can be thinned correspondingly.

Meanwhile, in the conventional coaxial connector disclosed in Japanese Patent Application Laid-open No. 2004-355932, after the plug and the receptacle are fitted and coupled to each other, the coupled state between the plug and the receptacle is generally maintained using a setscrew or a lock mechanism comprising a pawl integrally molded on a main body made of synthetic resin.

However, when the setscrew is used, there is a problem that it is troublesome to remove the setscrew. When the pawl is integrally molded on the main body using synthetic resin, a slide mold is necessary, labor is required for producing the same, and when the attaching and detaching operation of the plug and the receptacle must be carried out many times, there is an adverse possibility that a portion where the pawl is provided is bent or cracked.

As a countermeasure thereof, a structure in which a lock member made of metal piece is fixed to a main body can be conceived. In such a case, however, when the coaxial cable is pulled and an external force in a direction separating the plug and the receptacle from each other is applied, it is necessary that the lock member is not pulled out from the main body.

In this point, according to the present embodiment, the tongue piece 32*d* of the lock arm 32 is press-fitted into the insertion hole 31*f*, the lock arm 32 and the housing 31 can easily be formed integrally. The tongue piece 32*d* can be press-fitted until the rear end surface 32*e* of the fitting unit 32*a* of the lock arm 32 abuts against the front end surface 31*g* of the housing 31, and this operation can easily and reliably be completed.

With this structure, when an external force in a direction in which the coupling with respect to the receptacle 4 is released (i.e., a direction in which the housing block 3 separates from the receptacle; X direction) is applied to the housing block 3 from the coaxial cable 2 or the like, a force in the same direction of the external force is applied to the rear end surface 32*e* of the lock arm 32 from the front end surface 31*g* of the housing 31. Therefore, it is possible to prevent the lock arm 32 from being pulled out from the insertion hole 31*f* by the external force and to prevent the lock arm 32 from separating from the housing 31.

Meanwhile, according to the conventional coaxial connector disclosed in Japanese Patent Application Laid-open No. 2005-108510, when conductive materials (hot terminal and ground terminal) provided on the connecting bodies are assembled, the hot terminal is assembled in the ground terminal formed into the cylindrical shape through the insulator in any of the connecting bodies.

Therefore, when the connecting body is assembled, in the conventional technique, one independent hot terminal is fitted into the one independent ground terminal, and they are assembled one by one, the number of operating steps is increased and the operating time is increased, and the producing piece rate is naturally increased. Particularly in the case of the multi-pole coaxial connector provided with a plurality of coaxial cables, this tendency remarkably appears.

In this point, according to the present embodiment, the signal post 5 and the ground contact 6 are assembled in a state where they are connected to the hoops 100 and 101. As compared with a case where they are formed individually and assembled one by one independently, since the signal post 5 and the ground contact 6 are connected to the hoops 100 and 101, it is easy to handle them, the positioning operation can be no easily when they are assembled, the productivity of the housing block 3 can be enhanced and the producing cost can be reduced.

In the present embodiment, the signal post 5 is first separated from the hoop 100, and the plurality of assembly blocks 9 are connected by the hoop 101, but instead of this structure, the assembly blocks 9 can be connected by the hoop 100.

According to the present embodiment, the plurality of signal posts 5 can be provided with insulators at a time by insert molding the insulating block 51 in a state where it is connected to the hoop 100. Therefore, the productivity of the housing block 3 can be enhanced. The insulator can be fixed to the ground contact 6 connected to the hoop 101 by insert molding, or the insulator can be fixed to both the signal post 5 and the ground contact 6.

According to the present embodiment, the pitch of one of the signal posts 5 and the ground contacts 6 is integral multiple (an integer of one or more) of the pitch of the other one of the signal posts 5 and the ground contacts 6. Therefore, when the housing block 3 is assembled, the assembling operation of the signal posts 5 and the ground contacts 6 is carried out the integral multiple times while deviating the relative position between the hoops 100 and 101 (i.e., when the pitch (2P) of the ground contacts 6 is two times of the pitch (P) of the signal posts 5 as in the present embodiment, the assembling operation is repeated two times), so both of them can be used, and the housing block 3 can be obtained more easily. When the pitch of the signal posts 5 is integral multiple of the pitch of the ground contacts 6 also, the same effect can be obtained.

Figure 21B:
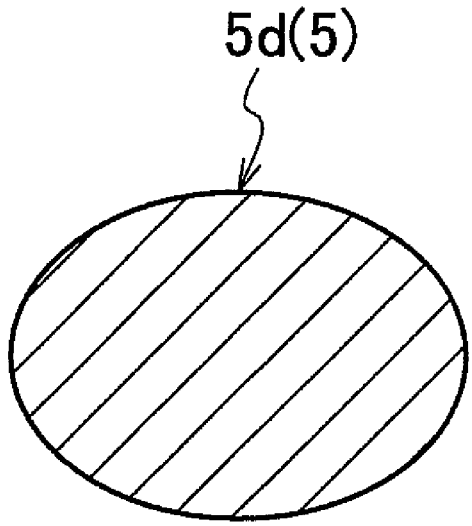

According to the present embodiment, it is possible to more easily and swiftly obtain the signal post 5 having a shape capable of largely securing a contact area with an outer peripheral surface of the tip end 5*c* (cross section in which corners of polygonal cross section are chamfered) by press processing in a hoop forming step. Since the tip end shape is obtained by pressing the hoop 100, a large amount processing can be carried out at the same time as compared with a case where pins are ground and polished one by one to form the tip ends and they are assembled, the productivity can further be enhanced. When the cross section of the tip end 5*c* of the signal post 5 is formed into substantially oval shape shown in FIG. 21B or a perfect circle shape, the same effect can be obtained.

According to the present embodiment, by substantially the V-shaped notch 52, the internal conductor 21 can be positioned at the predetermined mounting position of the signal post 5 precisely when the signal post 5 and the internal conductor 21 of the coaxial cable 2 are connected to each other, it can easily be temporarily be held at the predetermined mounting position, and the productivity can further be enhanced. When this portion is soldered, the contact area of solder can be increased and the conduction failure can be suppressed.

Meanwhile, in the conventional coaxial connector disclosed in Japanese Patent Application Laid-open No. 2004-355932, in the signal terminal and the ground terminal, the ground terminal is disposed beside the signal terminal at a portion projecting from the receptacle, the front surface of the signal terminal and the front surface of the ground terminal intersect with each other substantially at right angles. Therefore, although it projects from the receptacle in a state where the signal terminal and the ground terminal relatively approach each other, it is difficult to adjust the capacity component and to adjust the impedance at this portion.

In this point, according to the present embodiment, (the upper half 81*a*) of the signal SMD terminal 81 and the (upper half 71*a*) of the ground SMD terminal 71 project from the receptacle 4 in a state where their surface are opposed to each other at the predetermined distance δ. Therefore, the capacity component can relatively easily be adjusted by adjusting (setting) the distance (δ) therebetween or the overlapping area by the mutually opposed portions (i.e., the upper halves 71*a* and 81*a*). Thus, it becomes easy to adjust (set) the impedance characteristics, and it is possible to obtain the excellent coaxial connector 1 in which the noise can be reduced and the mutual interference between the signals can be suppressed.

Figure 20:
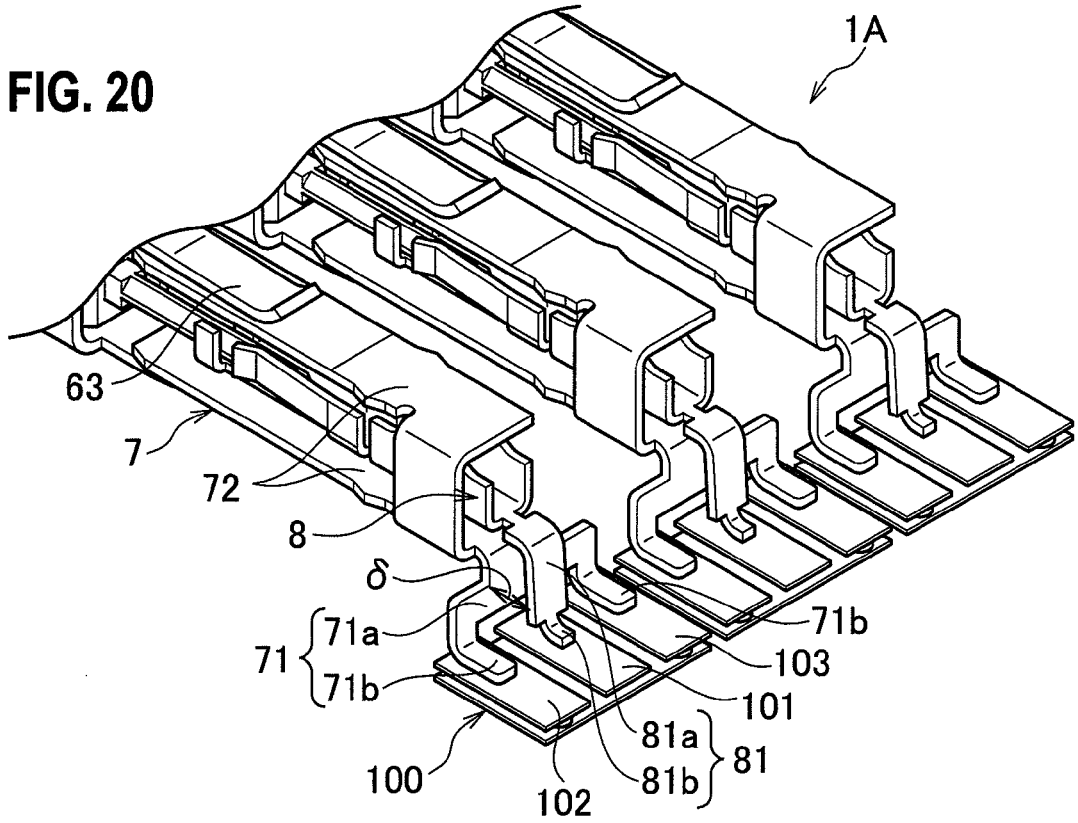
FIG. 20 is an enlarged perspective view of portions of the signal terminal and the ground terminal taken out from the receptacle as the stationary side connecting body of the multi-pole coaxial connector according to another embodiment of the invention.

FIG. 20 is an enlarged perspective view of portions of the signal SMD terminal and the grounding SMD terminal taken out from the receptacle in the coaxial connector according to another embodiment of the invention. A coaxial connector 1A according to the present embodiment has the same constituent elements as those of the coaxial connector 1. Thus, the same constituent elements are designated with like reference symbols, and redundant explanations thereof will be omitted. In FIG. 20, for the sake of convenience, the shell 41 of the receptacle 4 and the insulating body 42 are omitted and the signal contact 8 and the ground case 7 are exposed.

Also in the coaxial connector 1A according to the present embodiment shown in FIG. 20, the ground SMD terminal 71 is integrally formed on an end of one of the contact pieces 72 (upper contact piece 72 in FIG. 20) in the longitudinal direction, the ground SMD terminal 71 is bent at the base end of the contact piece 72 substantially at right angles and the upper half 71*a* is formed. The upper half 71*a* is branched into two, they are bent in a crank form and then, they are bent in the extending direction of the contact piece 72, the narrow two tip ends 71*b* project substantially in parallel to the contact piece 72.

The bifurcated tip ends 71*b* disposed astride the tip end 81*b* of the signal SMD terminal 81. That is, in the multi-pole coaxial connector 1A, structures in which tip ends 81*b* of the signal SMD terminal 81 are disposed on both sides of the tip end 71*b* of the ground SMD terminal 71 are arranged in the arrangement direction of the coaxial cables.

Also with this structure, the distance δ is set between the upper half 81*a* of the signal SMD terminal 81 and the upper half 71*a* of the ground SMD terminal 71.

As described above, according to the present embodiment shown in FIG. 20, since the bifurcated tip ends 71*b* of the ground SMD terminal 71 are disposed on both sides of the tip end 81*b* of the signal SMD terminal 81, noise can further be reduced, and the mutual interference between signals can further be suppressed. With this structure, when the ground potentials are individually set in the multi-pole coaxial connector, it is possible to more reliably suppress the mutual interference between signals.

While the exemplary embodiment of the present invention has been explained above, the present invention is not limited thereto, and various modifications can be made.

For example, the signal post 5, the ground contact 6, the ground case 7 and the signal contact 8 which are conductive materials are not limited to those of the present embodiment and other shapes can be employed in accordance with a purpose. The housing block 3 which is the coaxial cable connecting body and the receptacle 4 which is the stationary side connecting body are not limited to the shapes and structures described above, and any structure can be employed only if the internal conductive material can be held and protected and they can be attached to and detached from each other.

Further, although the lock arm is provided on the main body of the coaxial cable connecting body in the present embodiment, the present invention can also be carried out even if the lock arm is the coaxial connector provided on the main body of the stationary side connecting body. In this case, the separating direction is a direction in which the stationary side connecting body separates from the coaxial cable connecting body based on the stationary side connecting body as a reference.

The present invention can also be carried out even if the coaxial cable connecting bodies are connected to each other.

What is claimed is:

1. A multi-pole coaxial connector comprising:

a coaxial cable connecting body in which a plurality of combinations of a signal post connected to an internal conductor of a coaxial cable, and a ground contact which is fitted over the signal post through an insulator and which is further connected to an external conductor, are disposed in parallel to each other, and a stationary side connecting body in which a plurality of combinations of a signal contact having a signal terminal and a ground case having a ground terminal are disposed in parallel to each other, in which the coaxial cable connecting body and the stationary side connecting body are coupled to each other so as to bring the signal post and the signal contact into conduction, the ground contact and the ground case into conduction, the internal conductor and the signal terminal into conduction and the external conductor and the ground terminal into conduction, wherein a cross section of the ground contact is substantially a U-shape in which adjacent ground contact side is opened, wherein the signal contact includes a pair of contact pieces which sandwich the signal post from both sides with a compression force, wherein the ground case is fitted over the signal contact through an insulator and is sandwiched between a pair of contact pieces of the ground contact with a compression force, and wherein opening and closing directions of the pair of contact pieces of the ground contact and opening and closing directions of the pair of contact pieces of the signal contact are different from each other.

2. The multi-pole coaxial connector according to claim 1, wherein the ground contact includes a swaging unit which presses and fixes from outside of the external conductor, and a cross section of the swaging unit is substantially a U-shape surrounding outside of the external conductor except the adjacent ground contact side.

3. The multi-pole coaxial connector according to claim 1, wherein a cross section of the ground case is substantially a U-shape in which adjacent ground case side is opened.

4. The multi-pole coaxial connector according to claim 1, wherein a contact portion of the ground case sandwiched between the pair of contact pieces of the ground contact is configured as a flat-plate like shape.

5. The multi-pole coaxial connector according to claim 1, wherein the opening and closing directions of the pair of contact pieces of the ground contact are front and back directions of the stationary side connecting body, and a clearance hole to evade interference with the contact piece is provided in at least one of a front surface and a back surface of the stationary side connecting body.

6. The multi-pole coaxial connector according to claim 1, wherein the signal terminal and the ground terminal project from the stationary side connecting body in a state where their surface are opposed to each other at a predetermined distance.

7. The multi-pole coaxial connector according to claim 6, wherein a tip end of the ground terminal opposed to the signal terminal is bifurcated, and tip ends of the bifurcated portions are disposed astride the signal terminal.

* * * * *